US010434780B2

(12) United States Patent
Shindo

(10) Patent No.: US 10,434,780 B2
(45) Date of Patent: Oct. 8, 2019

(54) INK-JET PRINTER

(71) Applicant: BROTHER KOGYO KABUSHIKI KAISHA, Nagoya-shi, Aichi-ken (JP)

(72) Inventor: Tatsuya Shindo, Nagoya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/692,068

(22) Filed: Aug. 31, 2017

(65) Prior Publication Data

US 2018/0072062 A1 Mar. 15, 2018

(30) Foreign Application Priority Data

Sep. 9, 2016 (JP) ..... 2016-176738

(51) Int. Cl.
*B41J 2/165* (2006.01)
*B41J 2/045* (2006.01)
*B41J 2/21* (2006.01)

(52) U.S. Cl.
CPC ..... *B41J 2/16579* (2013.01); *B41J 2/04586* (2013.01); *B41J 2/16508* (2013.01); *B41J 2/16517* (2013.01); *B41J 2/16526* (2013.01); *B41J 2/16532* (2013.01); *B41J 2/2107* (2013.01); *B41J 2002/16573* (2013.01)

(58) Field of Classification Search
USPC ..... 347/19
See application file for complete search history.

(56) References Cited

U.S. PATENT DOCUMENTS 9,358,792 B2 * 6/2016 Fukuda ..... B41J 2/16508
2012/0075364 A1 3/2012 Nakazawa
2015/0158293 A1 * 6/2015 Suzuki ..... B41J 2/04588 347/9

FOREIGN PATENT DOCUMENTS

JP 2005-161660 A 6/2005
JP 2012-091500 A 5/2012

* cited by examiner

*Primary Examiner* — Lam S Nguyen
(74) *Attorney, Agent, or Firm* — Scully, Scott, Murphy & Presser, P.C.

(57) ABSTRACT

There is provided an ink-jet printer including: a tank storing a pigment ink; a head; a purge mechanism; and a controller controlling the head and the purge mechanism. The controller executes: obtaining sedimentation information regarding a sedimentation amount of a pigment inside the tank, and judging whether or not the sedimentation amount of the pigment inside the tank is not less than a predetermined amount, based on the obtained sedimentation information. Further, the controller executes a first purge operation as an initial introduction purge processing for initially introducing the pigment ink from the tank to the head. Furthermore, the controller executes, as the initial introduction purge processing, a second purge processing capable of jetting, from the nozzles, the pigment ink in a larger amount than that in the first purge processing, in a case that the controller judges that the sedimentation amount is not less than the predetermined amount.

15 Claims, 10 Drawing Sheets

Fig. 7

| | |
|---|---|
| FIRST PURGE | NORMAL INITIAL INTRODUCTION PURGE |
| SECOND PURGE | INITIAL INTRODUCTION PURGE FOR VISCOUS INK |
| THIRD PURGE | USER PURGE (WEAK PURGE) |
| FOURTH PURGE | USER PURGE (MEDIUM PURGE) |
| FIFTH PURGE | USER PURGE (STRONG PURGE) |
| SIXTH PURGE | MAINTENANCE PURGE |

INK-JET PRINTER

CROSS REFERENCE TO RELATED APPLICATION

The present application claims priority from Japanese Patent Application No. 2016-176738 filed on Sep. 9, 2016 the disclosure of which is incorporated herein by reference in its entirety.

BACKGROUND

Field of the Invention

The present invention relates to an ink-jet printer.

Description of the Related Art

In a publicly known ink-jet printer, any ink is not filled (charged) in an ink-jet head when the ink-jet printer is shipped from a factory. Before initial printing (before printing is performed for the first time), an initial purge for sucking an ink inside an ink cartridge from nozzles of the ink-jet head is executed, to thereby initially introduce the ink in the ink-jet head.

There is known an ink-jet printer which uses a pigment ink, as an ink to be used therein. Although the pigment ink has such an advantage that the clarity (distinctiveness), etc., of a printed image is improved, the pigment ink also have such a problem that, if allowed to stand still for a long period of time, the pigment sediments (settles) in a bottom portion of the tank. In a case that the pigment settles in the bottom portion of the tank in such a manner, the pigment concentration of the pigment ink is locally increased in the bottom portion of the tank, and the viscosity of the pigment ink is also increased as well. Accordingly, even if the above-described initial purge is performed in a state that the pigment settles in the tank, the pigment ink is not appropriately introduced to the inside of the head, which in turn results in any jetting failure (discharge failure) in the head.

In view of the above-described situation, an object of the present teaching is to provide an ink-jet printer capable of suppressing any ink discharge failure (ink jetting failure) in the head.

SUMMARY

According to an aspect of the present teaching, there is provided an ink-jet printer including: a tank configured to store a pigment ink; a head which is connected to the tank, which has nozzles for jetting the pigment ink supplied from the tank; a purge mechanism; and a controller configured to control the head and the purge mechanism. The controller is configured to perform: obtaining sedimentation information regarding a sedimentation amount of a pigment contained in the pigment ink in the tank; judging whether or not the sedimentation amount of the pigment in the tank is not less than a predetermined amount, based on the obtained sedimentation information; executing a first purge operation as an initial introduction purge processing for initially introducing the pigment ink from the tank to the head; and executing, as the initial introduction purge processing, a second purge processing capable of discharging, from the nozzles, the pigment ink in a larger amount than that in the first purge processing, in a case that the controller judges that the sedimentation amount is not less than the predetermined amount.

In the present teaching, even in a case that the sedimentation amount of the pigment in the inside the tank is not less than the predetermined amount, the second purge processing is executed to thereby make it possible to discharge (jet) such a pigment ink which is in the tank and in which the pigment concentration is locally increased due to the sedimentation (settlement) of the pigment, and to smoothly introduce the pigment ink to the inside of the head. As a result, it is possible to suppress the occurrence of jetting failure of the ink in the head. On the other hand, in such a case that the sedimentation amount of the pigment in the tank is less than the predetermined amount, the first purge processing is selected as the initial introduction purge processing, thereby making it possible to suppress a consumption amount of the ink.

BRIEF DESCRIPTION OF THE DRAWINGS

FIG. 7 is a view indicating the corresponding relationship of first to sixth purges with respect to two kinds of the initial introduction purge, three kinds of the user purge and one kind of a maintenance purge, respectively, which are executable by a controller.

DESCRIPTION OF THE EMBODIMENTS

Figure 1:
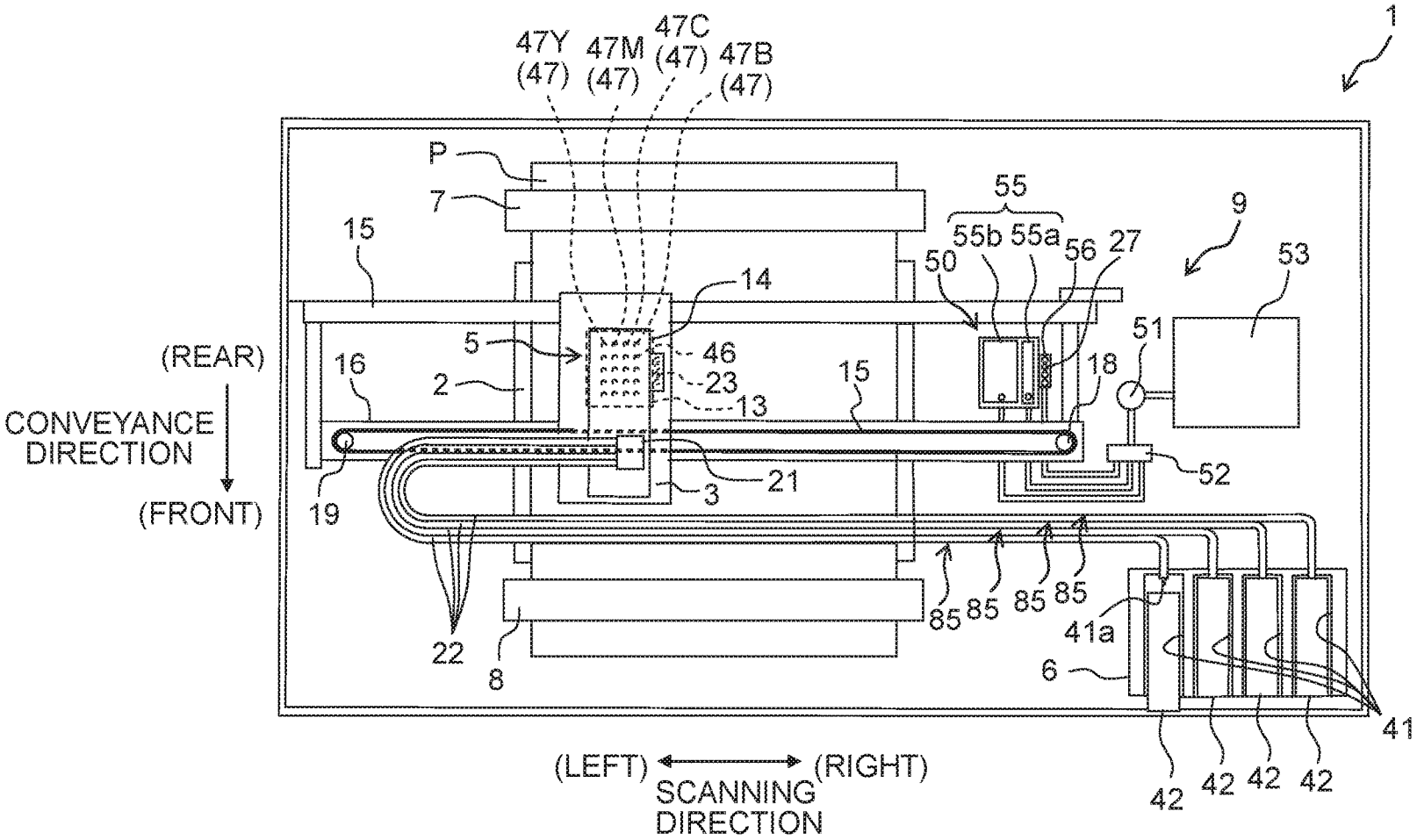
FIG. 1 is a view schematically depicting the configuration of an ink-jet printer according to an embodiment of the present teaching.

An explanation will be given about the configuration of an ink-jet printer 1 (hereinafter also referred to as the "printer 1") according to an embodiment of the present disclosure. As depicted in FIG. 1, the printer 1 is provided with a platen 2, a carriage 3, an ink-jet head 5 (hereinafter referred simply as the "head 5", as well), a holder 6, a paper feeding roller 7, a paper discharging roller 8, a maintenance unit 9, a user interface 90 (see FIG. 2), a temperature sensor 91 (see FIG. 2), a scanner unit 92 (see FIG. 2), a controller 100 (see FIG. 2), etc. Note that in the following explanation, the side in front of the sheet surface of FIG. 1 is defined as "upper side, upward" of the printer 1, and the far side of the sheet surface of FIG. 1 is defined as "lower side, downward" of the printer 1. Further, the front-rear direction and the left-right direction depicted in FIG. 1 are defined as the "front-rear direction" and the "left-right direction" of the printer 1. In the following explanation, the respective directional terms such as the front-rear, left-right and up-down will be appropriately used.

A paper P (sheet P, paper sheet P) as a recording medium is placed on the upper surface of the platen 2. Further, two guide rails 15 and 16, extending in parallel to each other in the left-right direction (scanning direction) are disposed at a location above the platen 2.

The carriage 3 is attached to the two guide rails 15, 16 and is movable in the scanning direction along the two guide rails 15, 16 in an area facing the platen 2. Further, a driving belt 17 is attached to the carriage 3. The driving belt 17 is a loop-shaped belt wound around two pulleys 18 and 19. The pulley 18 as one of the two pulleys 18, 19 is connected to a carriage driving motor 20 (see FIG. 2). The pulley 18 is driven and rotated by the carriage driving motor 20, thereby allowing the driving belt 17 to run, which in turn reciprocates the carriage 3 in the scanning direction. Further, in this state, the head 5 mounted on the carriage 3 is reciprocated in the scanning direction, together with the carriage 3.

The holder 6 is provided with four cartridge installing sections 41 which are arranged side by side in the left-right direction. Four ink cartridges 42 are installed attachably/detachably with respect to the four cartridge installing sections, respectively. The four ink cartridges 42 installed in the four cartridge installing sections 41 store mutually different pigment color inks which are pigment inks of black, yellow, cyan and magenta colors, respectively.

Further, each of the cartridge installing sections 41 is capable of selectively installing a plurality of kinds of the ink cartridge 42 of which volumes are mutually different. In the embodiment, each of the cartridge installing sections 41 is capable of selectively installing a small volume ink cartridge 42*a* having a small volume and a large volume ink cartridge 42*b* having a large volume, as depicted in FIGS. 3A and 3B.

Figure 3A:
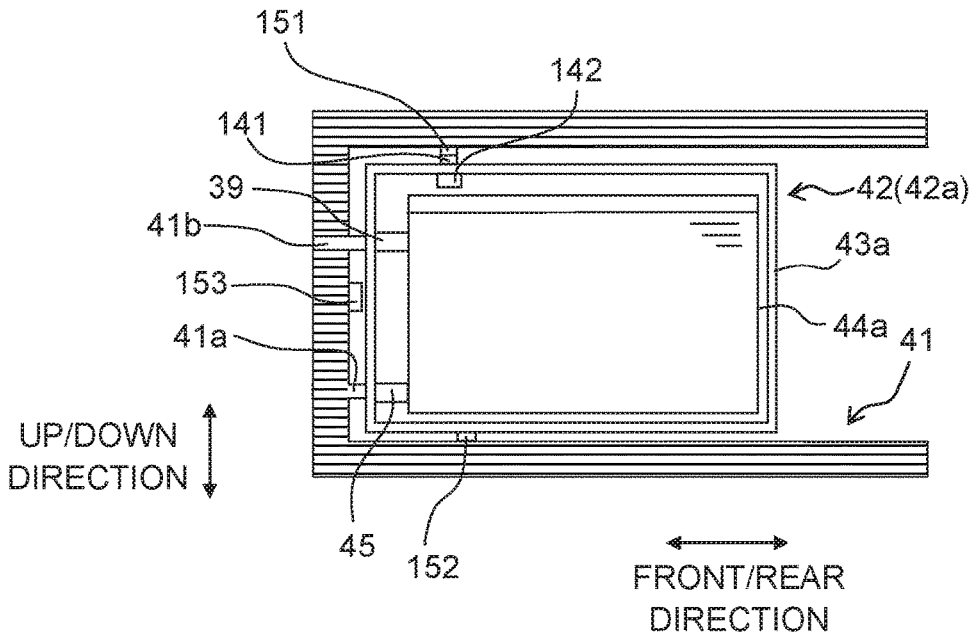
FIGS. 3A and 3B are each a side cross-sectional view of an ink cartridge and a cartridge installing section, depicting a state that the ink cartridge is installed in the cartridge installing section.
Figure 3B:
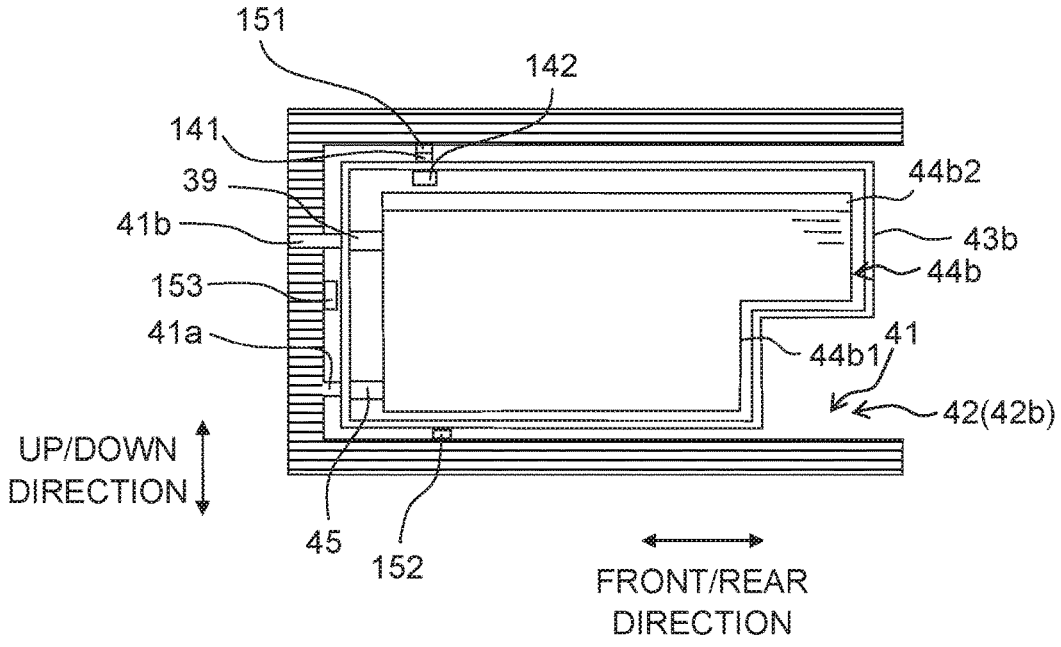

As depicted in FIG. 3A, the small volume ink cartridge 42*a* is provided with: a casing 43*a* having a substantially rectangular parallelepiped shape; a storage chamber 44*a* arranged in the casing 43*a*, having a substantially rectangular parallelepiped shape and configured to store an ink; a discharge pipe 45 connected to a lower portion of the storage chamber 44*a*; and an atmosphere communicating section 39 connected to the storage chamber 44*a*.

The discharge pipe 45 defines a channel via which the ink stored in the storage chamber 44*a* is supplied to the outside of the ink cartridge 42*a*. Each of the cartridge installing sections 41 is provided with a needle 41*a* which is connected to the discharge pipe 45 in a case that the ink cartridge 42*a* is installed in the cartridge installing section 41 and via which the ink is flowed.

The atmosphere communicating section 39 is provided with: a channel via which the storage chamber 44*a* is communicated with the outside of the ink cartridge 42*a*; a valve disposed on the channel; and the like. In a case that the ink cartridge 42*a* is installed in the cartridge installing section 41, the valve is opened to thereby allow the storage chamber 44*a* to communicate with the atmosphere via an atmosphere communication channel 41*b* formed in the cartridge installing section 41.

Further, the ink cartridge 42*a* is provided with a contact point 141 arranged on an outer surface of the casing 43*a*, and a memory 142 arranged in the casing 43*a* and electrically connected to the contact point 141. The memory 142 previously stores information regarding the shipment time (year, month, date, etc. of the shipment) of the ink cartridge 42, information regarding the volume of the ink cartridge indicating that the ink cartridge itself is the small volume ink cartridge 42*a*, etc. Note that the information regarding the volume of the cartridge may be an initial storage amount of the ink in the ink cartridge at the time of the shipment of the ink cartridge. In the following explanation, the information regarding the shipment time is referred to as the shipment time information, and the information regarding the volume of the cartridge is referred to as the volume information.

The cartridge installing section 41 is provided with a contact point 151 which is electrically connected to the contact point 141 in a case that the ink cartridge 42*a* is installed in the cartridge installing section 41. By the electrical connection between the contact point 141 of the ink cartridge 42*a* and the contact point 151 of the cartridge installing section 41, the controller 100 is allowed to refer to the content (information, etc.) stored in the memory 142 of the ink cartridge 42*a*. Further, the cartridge installing section 41 is provided with an installation detecting sensor 152 configured to detect whether or not the ink cartridge 42 is installed in the cartridge installing section 41, and an optical sensor 153 configured to detect whether or not an ink remaining amount of the ink in the ink cartridge 42 becomes to be less than a predetermined amount (for example, near empty).

Next, an explanation will be given about the large volume ink cartridge 42*b*. Note that the above-described small volume ink cartridge 42*a* and the large volume ink cartridge 42*b* are different from each other only in the configurations of the casing and the storage chamber, and are same in view of the remaining configurations other than those of the casing and the storage chamber. Specifically, as depicted in FIG. 3B, a storage chamber 44*b* of the ink cartridge 42*b* has a lower side storage portion 44*b*1 and an upper side storage portion 44*b*2 arranged to be above the lower side storage portion 44*b*1. The width dimension in the up-down direction and the width dimension in the left-right direction of the storage chamber 44*b* is same as those of the storage chamber 44*a* of the small volume ink cartridge 42*a*. Further, the width dimension in the front-rear direction of the lower side storage portion 44*b*1 is same as that of the storage chamber 44*a* of the small volume ink cartridge 42*a*. On the other hand, the width dimension in the front-rear direction of the upper side storage portion 44*b*2 is longer than that of the storage chamber 44*a* of the small volume ink cartridge 42*a*. Accordingly, the storage chamber 44*b* is capable of storing the ink in a larger amount than that storable in the storage chamber 44*a*. Furthermore, the base area (the area of the base) of the storage chamber 44*a* is same as that of the storage chamber 44*b* (lower side storage portion 44*b*1). The casing 43*b* of the ink cartridge 42*b* has a shape along (conforming to) the shape of the storage chamber 44*b*.

Further, the ink cartridge 42*b* has an atmosphere communicating section 39, a discharge pipe 45, a contact point 141 and a memory 142, similarly to the ink cartridge 42*a*. The memory 142 of the ink cartridge 42*b* previously stores the information regarding the shipment time, the information regarding the volume of the ink cartridge indicating that the ink cartridge itself is the large volume ink cartridge 42*b*, etc. Furthermore, the height position in the up-down direction of the connection position at which the discharge pipe 45 and the storage chamber 44*b* are connected to each other in the ink cartridge 42*b* is same as the height position in the up-down direction of the connection position at which the discharge pipe 45 and the storage chamber 44*a* are connected to each other in the ink cartridge 42*a*.

Returning to FIG. 1, the head 5 is installed in the carriage 3. The head 5 includes a body 13 of head (head body 13) and a sub tank 14. A tube joint 21 is disposed on the upper surface of the sub tank 14, and four ink supply tubes 22 are connected to the tube joint 21 at one ends of the four ink supply tubes 22 in a removable or detachable manner with respect to the tube joint 21. The other ends of the four ink supply tubes 22 are connected to the needles 41*a* of the four cartridge installing sections 41, respectively, of the holder 6. The inks inside the four ink cartridges 42 which are installed in the cartridge installing sections 41 are supplied, via the four ink supply tubes 22, respectively, to the sub tank 14.

The head body 13 is attached to a lower portion of the sub tank 14. The head body 13 has a plurality of nozzles 46 formed on the lower surface of the head body 13, and head flow channels 48 (see FIG. 5) communicating with the nozzles 46. The inks are supplied to the head body 13 from the sub tank 14, and the inks are jetted (discharged) from the plurality of nozzles 46. The plurality of nozzles 46 construct four nozzle rows 47 which are arranged side by side in the left-right direction. The four nozzle rows 47 are composed of a nozzle row 47Y via which the yellow ink is jetted, a nozzle row 47M via which the magenta ink is jetted, a nozzle row 47C via which the cyan ink is jetted, and a nozzle row 47K via which the black ink is jetted. In such a manner, the four nozzle rows 47 jet the inks of mutually different colors.

Figure 4:
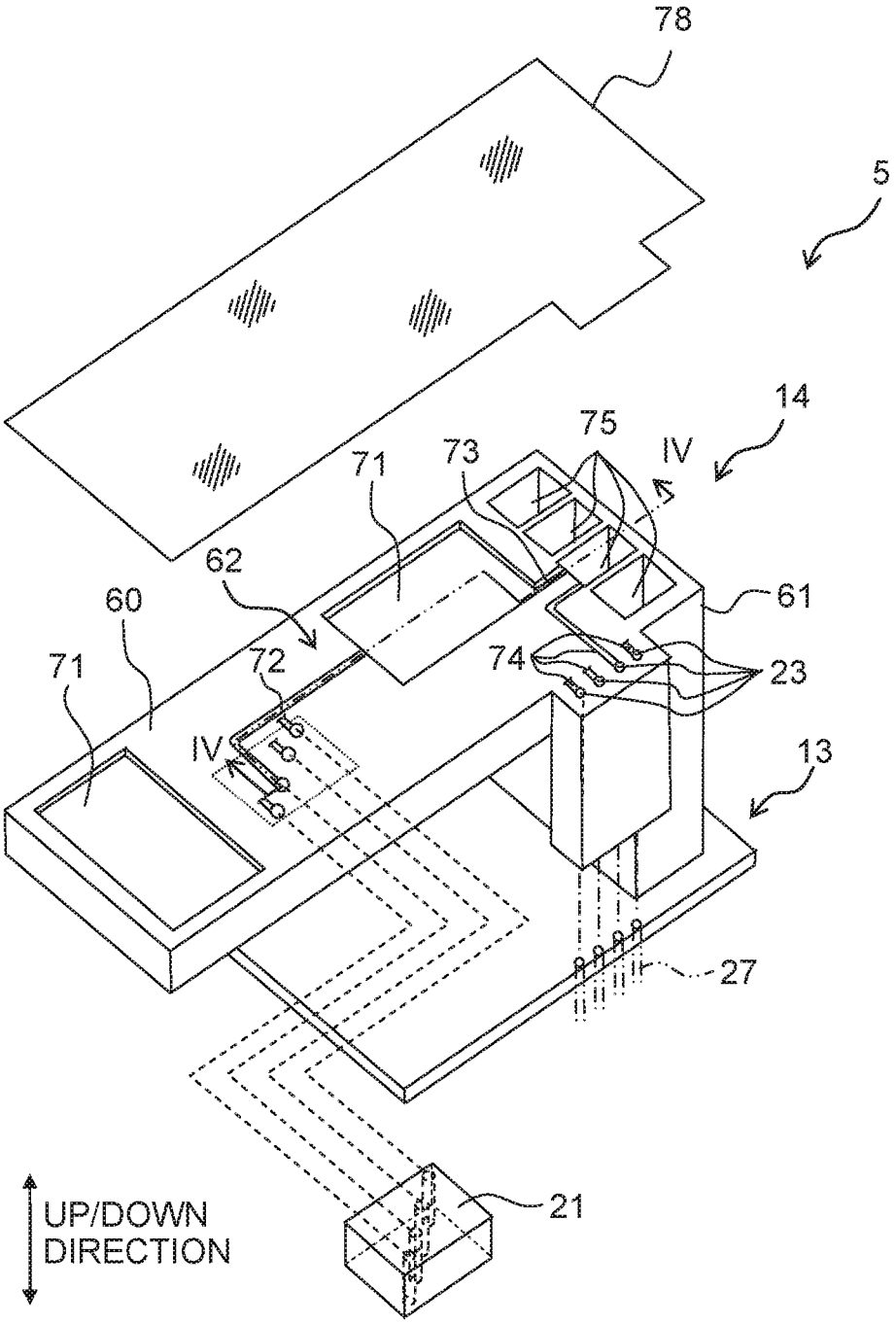
FIG. 4 is a perspective view of an ink-jet head.
Figure 5:
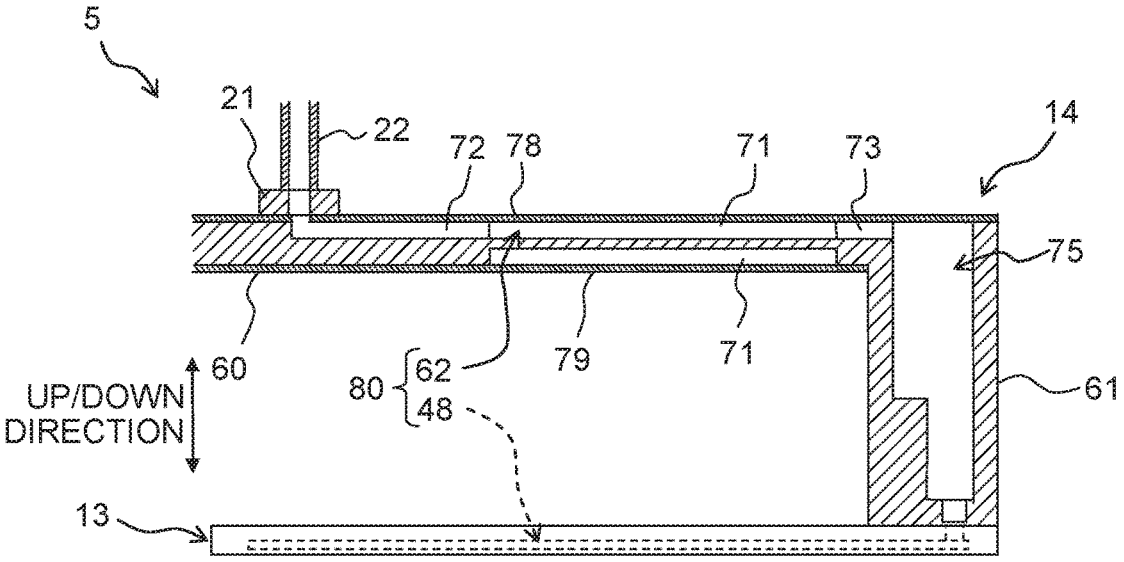
FIG. 5 is a vertical cross-sectional view taken along a line V-V of FIG. 4.

The sub tank 14 is a member formed of a synthetic resin. As depicted in FIGS. 4 and 5, the sub tank 14 includes a body portion 60 having a plate-shape extending along a horizontal plane, and a connecting portion 61 extending downward from an end portion of the body portion 60 and connected to the head body 13. The sub tank 14 is formed with four supply channels 62 via each of which one of the four color inks is supplied to the head body 13. Note that in FIG. 4, only one of the four supply channels 62 is entirely depicted in the drawing, but a part of the remaining three supply channels 62 is omitted in the drawing, so as to simplify the illustration.

The tube joint 21, to which the four ink supply tubes 22 are connectable, is attached to the upper surface of the body portion 60. By connecting the ink supply tubes 22 to the tube joint 21, the inks stored in the ink cartridges 42 can be supplied to the supply channels 62, respectively.

Each of the supply channels 62 has a damper chamber 71 formed in the body portion 60, and a connecting channel 75 formed in the connecting portion 61. The damper 71 is a recessed portion formed on a surface of the body portion 60; four damper chambers 71 corresponding to the four color inks, respectively, are arranged such that two damper chambers 71 are arranged on the side of the upper surface of the body portion 60 and two damper chambers 71 are arranged on the side of the lower surface of the body portion 60. As depicted in FIG. 5, each of the damper chambers 71 on the side of the upper surface is arranged to be back to back relative to one of the damper chambers 71 on the side of the lower surface. Further, the damper chambers 71 formed in the upper surface of the body portion 60 are connected to the tube joint 21 respectively by channels 72 having a recessed shape and formed also in the upper surface of the body portion 60. Furthermore, each of these damper chambers 71 is connected to the connecting channel 75 by one of channels 73 formed in the upper surface of the body portion 60. Note that although the illustration of the damper chambers 71 formed in the lower surface of the body portion 60 are omitted in FIG. 4 so as to simplify the drawing, the damper chambers 71 formed in the lower surface are also connected to the tube joint 21 and to the connecting channels 75 respectively by channels formed in the lower surface of the body portion 60.

Flexible films 78 and 79 are adhered on both the upper and lower surfaces, respectively, of the body portion 60, and the channels including the damper chambers 71 formed in the body portion 60 are covered by the films 78 and 79. Further, although the damper chambers 71 and the channels 72 and 73 arranged on the front and rear sides, respectively, of the damper chambers 71 have a substantially same depth, the damper chambers 71 are formed to have a channel width that is considerably greater than those of the channels 72 and 73 each having the recessed shape. With this, each of the supply channels 62 has a channel shape of which volume is locally great at the damper chamber 71 thereof. In a case that the ink is consumed in the head body 13, the pressure of the ink inside the head body 13 is decreased; corresponding to this, the ink is supplied from the ink cartridge 42 to the supply channel 62 in the sub tank 14. At this time, in a case that any large fluctuation or variation in the pressure is generated in the ink inside the supply channel 62, this pressure fluctuation is transferred up to the head body 13, which in turn adversely affects the jetting of the ink. However, by providing the damper chambers 71 having the large volume and covered by the flexible films 78 and 79 on the supply channels 62, any pressure fluctuation generated in the ink inside each of the supply channels 62 is absorbed at the damper chamber 71.

Further, as depicted in FIG. 4, the body portion 60 is also formed with four exhaust channels 74 connected to the four connecting channels 75, respectively. The four exhaust channels 74 are extended up to four exhaust portions 23, respectively, which are disposed on the rightward surface (a portion of the surface closer to the right end) of the sub tank 14. A forward end portions of each of the respective four exhaust portions 23 is an opening (is opened). Further, a valve (omitted in the drawings) configured to switch between communication and closing with respect to the outside (of the exhaust portions 23) is arranged in each of the four exhaust portions 23. Also regarding the four exhaust channels 74, only one of the four exhaust channels 74 formed in the upper surface of the body portion 60 is entirely depicted in the drawing, but a part of the remaining three exhaust channels 74 is omitted in the drawing, so as to simplify the illustration.

Note that in the following description, the channels each composed of one of the supply channels 62 and one of the head flow channels 48 are referred to as "intra-head channels 80", as depicted in FIG. 5 so as to simplify the explanation. Further, the entire channel which includes each of the intra-head channels 80 and starting from the connection position, in each of the ink supply tubes 22, at which the ink supply tube 22 is connected to one of the ink cartridges 42 and reaching the plurality of nozzles 46 is referred to as an "entire ink channel 85" (see FIG. 1).

Figure 2:
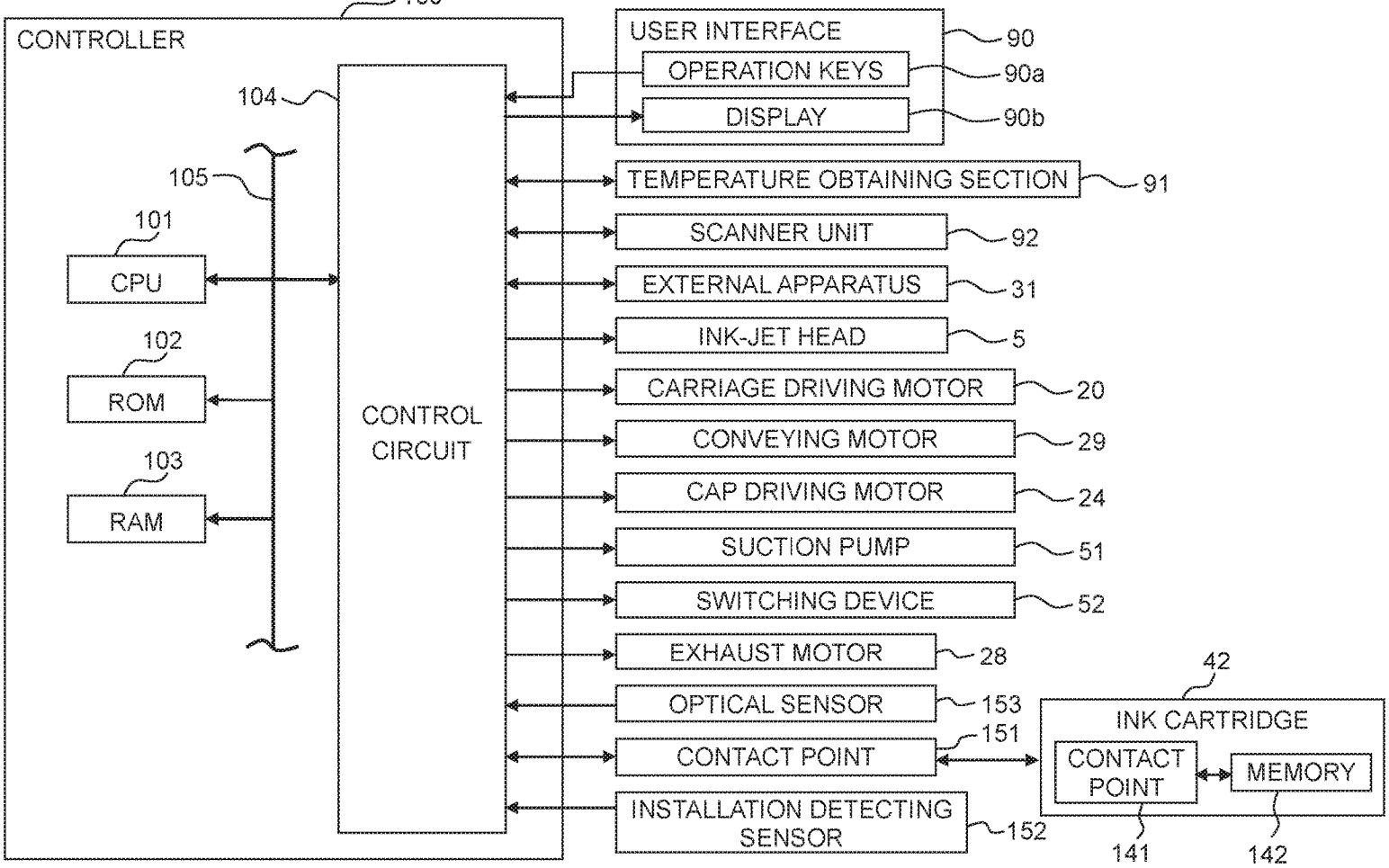
FIG. 2 is a block diagram schematically depicting the electrical configuration of the ink-jet printer.

Returning to FIG. 1, the paper feeding roller 7 and the paper discharging roller 8 are rotated and driven synchronously to each other by a conveying motor 29 (see FIG. 2). The paper feeding roller 7 and the paper discharging roller 8 cooperate to convey a paper P (sheet P, paper sheet P) placed on the platen 2 in a conveyance direction depicted in FIG. 1.

Further, the printer 1 causes the inks to be jetted, while moving the carriage 3 together with the head 5 in the scanning direction and causing the paper feeding roller 7 and the paper discharging roller 8 to convey the paper P in the conveyance direction, thereby printing a desired image, etc. on the paper P. Namely, the printer 1 of the present embodiment is an ink-jet printer of a serial system.

The maintenance unit 9 is configured to execute a maintenance operation for maintaining and recovering the jetting function of the head 5, and is provided with a cap unit 50, a suction pump 51, a switching device 52, a waste liquid tank 53, etc.

The cap unit 50 is arranged at a position on one side in the scanning direction (the right side in FIG. 1) relative to the platen 2; in a case that the carriage 3 is moved on the right side relative to the platen 2, the carriage 3 faces (is opposite to) the cap unit 50 in the up-down direction. Further, the cap unit 50 is driven by a cap driving motor 24 (see FIG. 2) to be ascendable (liftable)/descendable in the up-down direction (movable in the up-down direction). The cap unit 50 is provided with a nozzle cap 55 and an exhaust cap 56 both of which are capable of making contact with the head 5 and installable in the head 5. The nozzle cap 55 is formed, for example, of a rubber material, and has a black cap portion 55*a* and a color cap portion 55*b*.

In a state that the carriage 3 faces the cap unit 50, the nozzle cap 55 faces the lower surface of the head body 13, and the exhaust cap 56 faces the lower surfaces of the four exhaust portions 23 of the sub tank 14. Further, in a case that the cap unit 50 is lifted in the state that the carriage 3 faces the cap unit 50, the cap unit 50 is installed in the head body 13 and the sub tank 14. In this situation, all the nozzles 46 belonging to the nozzle row 47K are covered by the black cap portion 55*a*, and all the nozzles 46 belonging to the three nozzle rows 47Y, 47M and 47C are covered collectively by the color cap portion 55*b*. Furthermore, in this situation, the exhaust cap 56 is connected to the four exhaust portions 23 and collectively covers the openings in the forward end portions of the exhaust portions 23. Moreover, four stick-shaped (bar-shaped) opening/closing members 27 each of which is configured to open/close the valve inside one of the four exhaust portions 23 are attached to the exhaust cap 56. Although any detailed explanation for the stick-shaped opening/closing members 27 is omitted, in a state that the exhaust cap 56 is connected to the four exhaust portions 23, the four stick-shaped opening/closing members 27 are driven to be movable in the up-down direction by an exhaust motor 28 (see FIG. 2), and are inserted respectively into the exhaust portions 23 from therebelow, thereby driving the valves inside the exhaust portions 23, respectively.

The black cap portion 55*a* and the color cap portion 55*b* of the nozzle cap 55, and the exhaust cap 56 are connected to the suction pump 51 via the switching device 52. The switching device 52 switches the connection destination of the suction pomp 51 selectively among the black cap portion 55*a*, the color cap portion 55*b* and the exhaust cap 56. The waste liquid tank 53 is connected to the suction pump 51 in a portion thereof on a side opposite to another portion of the suction pump 51 closer to the switching device 52.

Further, the printer 1 is capable of causing the maintenance unit 9 to perform a suction purge and an exhaust purge as the maintenance operation, by the control executed by the controller 100.

The suction purge is a purge for forcibly jetting (discharging) the ink(s) from the nozzles 46. In a case of performing the suction purge for forcibly jetting the black ink from the nozzles 46 belonging to the nozzle row 47K, the suction pump 51 is driven in a state that the nozzles 46 are covered by the nozzle cap 55 and that the black cap portion 55*a* is communicated with the suction pump 51. With this, the pressure inside the black cap portion 55*a* becomes negative, thereby applying conveying pressure in a direction from the ink cartridge 42 toward the nozzles 46 to the black ink in the entire nozzle channel 85 and in the black ink in the ink cartridge 42, resulting in the black ink to be forcibly jetted from the nozzles 46.

Similarly, in a case of performing the suction purge for forcibly jetting the color inks from the nozzles 46 belonging to the nozzle rows 47Y, 47M and 47C, the suction pump 51 is driven in a state that the nozzles 46 are covered by the nozzle cap 55 and that the color cap portion 55*b* is communicated with the suction pump 51.

The exhaust purge is a purge for exhausting air such as air bubbles, etc., grown in the supply channels 62, etc. of the sub tank 14 from the exhaust portions 23, before such air moves into the head body 13. In a case of performing the exhaust purge, the suction pump 51 is driven after the suction pump 51 is communicated with the exhaust cap 56 by the switching device 52 in a state that the exhaust cap 56 is connected to the exhaust portions 23 and that the valve in each of the exhaust portions 23 is opened (released) by one of the opening/closing members 27. With this, the pressure inside the exhaust portions 23 becomes negative, thereby making it possible to exhaust the air in the four supply channels 62 from the exhaust portions 23 at the same time.

The ink(s) jetted from the head 5 by the suction purge or the exhaust purge is (are) sent to the waste liquid tank 53 connected to the suction pump 51.

The user interface 90 is an interface via which information is outputted to a user and information is obtained from the user; in the embodiment, the user interface 90 is provided with operation keys 90*a* and a display 90*b*, as depicted in FIG. 2. Any input form the user is received via the operation keys 90*a*, and is outputted to the controller 100. The display 90*b* displays a various kinds of information in accordance with an instruction from the controller 100.

The temperature sensor 91 has a temperature sensor arranged in the vicinity of the cartridge installing sections 41, and obtains a parameter regarding the temperatures of the ink cartridges 42. Note that, provided that the temperature sensor is capable of directly measuring the temperatures of the ink cartridges 42, it is allowable that the temperature sensor 91 obtains the result of the measurement, by the temperature sensor, as the parameter. On the other hand, in a case that the temperature sensor can measure only the ambient temperature around the ink cartridges 42 and/or the internal temperature inside the ink-jet printer 1, it is allowable that the temperature sensor 91 obtains the temperatures of the ink cartridges 42, presumed from the measured ambient temperature and/or the measure internal temperature, as the parameter. Further, it is allowable that the temperature sensor 91 obtains a parameter which varies with, while being linked to, the temperatures of the ink cartridges 42, as the parameter regarding the temperatures of the ink cartridges 42. The temperature sensor 91 outputs the parameter obtained in the above-described manner to the controller 100.

The scanner unit 92 has a CCD, a CIS, etc., and reads an image printed on a paper P in accordance with an instruction from the controller 100 so as to generate an image data regarding the image. Further, the scanner unit 92 reads a test pattern printed on a paper P in accordance with an instruction from the controller 100 so as to analyze an ink-jetting state of the nozzles 46 (presence or absence of any non-jetting nozzle (any nozzle with jetting failure), etc.) based on the read test pattern.

As depicted in FIG. 2, the controller 100 includes a CPU (Central Processing Unit) 101, a ROM (Read Only Memory) 102, a RAM (Random Access Memory) 103, a control circuit 104, a bus 105, etc. The ROM 102 stores a program executed by the CPU 101, a various kinds of fixed data, etc. The RAM 103 temporarily stores a data required when a program is executed (an image data, etc.). The control circuit 104 is connected to various devices (units) or driving sections of the printer 1, such as the head 5, the carriage driving motor 20, the cap driving motor 24 which moves the cap unit 50 upwardly and downwardly, and the like. Further, the control circuit 104 is connected to an external apparatus 31 such as a PC, etc. The CPU 101 controls the head 5, the carriage driving motor 20, etc. via the control circuit 104, based on a print instruction sent from the external apparatus 31, to thereby print an image, etc., on the paper P. Furthermore, the CPU 101 controls the suction pump 51, the switching device 52, etc. via the control circuit 104 to thereby execute the suction purge and the exhaust purge.

Note that in the embodiment, although the controller 100 is configured to execute the respective processings with the single CPU, the controller 100 may be configured to execute the respective processings with a plurality of CPUs, a single ASIC (Application Specific Integrated Circuit), a plurality of ASICs, or a combination of the CPU and a specific ASIC.

Here, in the ink-jet printer 1 of the embodiment, the suction purge executable by the maintenance unit 9 by the control performed by the CPU 101 can be roughly classified into three kinds of purges that are a maintenance purge, a user purge and an initial introduction purge. In the following, these purges will be explained.

The maintenance purge and the user purge are each a purge of which purpose is causing an ink, etc., which becomes highly viscous due to any foreign matter or substance, air bubble, drying, etc., inside the head 5, to be jetted from the nozzles 46 to thereby restore or recover the jetting characteristic of the nozzles 46. The maintenance purge includes a periodic purge which is performed after a predetermined period of time is elapsed since the image recording operation has been performed last time, and/or a purge which is executed immediately after the power source is switched on (except for the turning on the power source switch for the first time).

On the other hand, the user purge is a purge of which the conveyance pressure (suction pressure) applied by the suction pump 51 to the ink in the entire ink channel(s) 85 is stronger than that in the maintenance purge. Specifically, in the present embodiment, the rotation speed of the suction pump 51 is faster and the driving time of the suction pump 51 (the period of time during which the conveyance pressure is applied to the pigment ink) is also longer than those in the user purge. Accordingly, even in a case that the extent of the increase in viscosity of the ink in the head 5 is great and that the jetting characteristic of the nozzles 46 cannot be recovered by the maintenance purge, it is possible to recover the jetting characteristic of the nozzles 46 by performing the user purge.

Note that in the embodiment, the user purge includes three kinds of purges that are a weak purge, a medium purge and a strong purge. The medium purge is a purge satisfying at least one of a condition that the rotation speed of the suction pump 51 is faster than that in the weak purge, and a condition that the driving time of the suction pump 51 is longer than that in the weak purge. Further, the strong purge is a purge satisfying at least one of a condition that the rotation speed of the suction pump 51 is faster than that in the medium purge, and a condition that the driving time of the suction pump 51 is longer than that in the medium purge. Accordingly, the amount of the ink jetted from the nozzles 46 is increased in an ascending order of: the weak purge, the medium purge and the strong purge.

The user purge as described above is executed in accordance with the operation of the user interface 90 by the user. For example, the CPU 101 controls the head 5, the carriage driving motor 20, etc., based on the operation by the user via the user interface 90 so as to print a test pattern for checking non-jetting nozzle (for checking nozzle-slip out) on a paper P. Afterwards, the CPU 101 causes the user to evaluate, via the user interface 90, the result of printing of the test pattern on four scales that are L1 to L4. The scales L1 to L4 are ordered according to the number of non-jetting nozzles, in the result of printing of the test pattern, in the ascending order: L1, L2, L3 and L4. In a case that the user evaluates that the result of printing of the test pattern is L1, the CPU 101 does not cause the maintenance unit 9 to perform the user purge. On the other hand, in case that the user evaluates that the result of printing of the test pattern is L2, the CPU 101 causes the maintenance unit 9 to perform the weak purge; in case that the user evaluates that the result of printing of the test pattern is L3, the CPU 101 causes the maintenance unit 9 to perform the medium purge; and in case that the user evaluates that the result of printing of the test pattern is L4, the CPU 101 causes the maintenance unit 9 to perform the strong purge. As described above, by executing the user purge depending on the evaluation of the test pattern performed by the user, it is possible to recover the jetting characteristic of the nozzles 46 in an ensured manner.

Next, an explanation will be given about the state of the printer 1 at a time of being shipped from a factory, before explaining the initial introduction purge. At the time of shipment from the factory, the ink cartridges 42 are not installed in the cartridge installing sections 41, respectively; rather, the ink cartridges 42 are packaged in a same accommodation box together with the printer 1.

Further, at the time of shipment from the factory, a preservative solution is filled in the intra-head channels 80, etc., for the purpose of preserving the function of the head 5. Here, in a case that, for example, a pigment ink is used as the preservative solution, a problem will arise in view of the following points. Namely, a coloring material used in the pigment ink aggregates as the time passes, in some cases. Accordingly, in a case that the pigment ink is filled in the intra-head channels 80 of the head 5 for a long period of time, there is such a possibility that any jetting failure might arise.

In view of this, the present embodiment uses, as the preservative solution, a solution (liquid) in which the amount of the coloring material of the pigment is smaller than that in the ink, or a solution which does not contain any coloring material. Such a preservative solution is considerably less expensive than the ink, due to the content of the coloring agent smaller than that in the ink. Further, a surfactant is added to the preservative solution for the purpose of allowing, when the preservative solution is introduced into the intra-head channels 80, the preservative solution to be introduced up to a minute or fine portion of each of the intra-head channels 80, and thus the preservative solution has a smaller surface tension than that of the ink.

The initial introduction purge is performed in a case that the power source of the printer 1 is switched on by the user for the first time after the shipment from the factory and that the ink cartridges 42 are installed in the cartridge installing sections 41, for the purpose of jetting (discharging) the preservative solution filled in the intra-head channels 80 of the head 5 from the nozzles 46, and for the purpose of introducing the inks from the ink cartridges 42 to the intra-head channels 80.

In the initial introduction purge, it is necessary that the inks are introduced from the ink cartridges 42 to the intra-head channels 80 in which the inks are not filled at all.

Accordingly, the driving time (suction time) of the suction pump 51 in the initial introduction purge is longer than those in the maintenance purge and the user purge.

Here, the discloser of the present application found out that in a case that the ink cartridge 42 storing the black pigment ink is allowed to stand still for a long period of time before being installed in the cartridge installing section 41, the black pigment ink is not appropriately introduced into the intra-head channel 80 even when a normal initial introduction purge is performed; and that the jetting failure of the ink might occur in the head 5, as a result. This will be explained specifically in the following.

In the pigment ink, the pigment is present in a state that the pigment is dispersed in a solvent; in a state that the pigment ink is allowed to stand still for a long period of time, the pigment of which specific gravity is large settles (sediments) in the bottom portion of the ink cartridge 42. The amount of sedimentation (sedimentation amount) of the pigment in this situation is greater in the ink cartridge 42 storing the black pigment ink than in the ink cartridges 42 storing the color pigment inks that are the yellow, cyan and magenta pigment inks. This is because in the black pigment ink, the particle size and weight of the pigment particles are greater than those in the color pigment inks, and the amount of the pigment particles are greater than those in the color pigment inks.

As described above, in a case that the ink cartridge 42 storing the black pigment ink is allowed to stand still for a long period of time, the pigment settles in a large amount in the bottom portion of the ink cartridge 42. As a result, the pigment concentration of the pigment ink becomes locally great in the bottom portion of the ink cartridge 42, and the viscosity of the black pigment ink is also increased in the bottom portion of the ink cartridge 42. Thus, even when the normal initial introduction purge is performed with the pigment black ink of which viscosity is increased, such a problem arises that the pigment ink in the ink cartridge 42 is introduced only up to an intermediate portion of the intra-head channel 80 (for example, only up to an intermediate portion of the ink supply tube 22), and that the pigment ink is not introduced up to the nozzles 46 as the distal end of the intra-head channel 80.

Accordingly, the CPU 101 in the embodiment is capable of causing the maintenance unit 9 to execute two kinds of the initial introduction purge that are a normal initial introduction purge and an initial introduction purge for viscous ink, as the initial introduction purge regarding the black pigment ink, for the purpose of solving the above-described problem.

Figure 6:
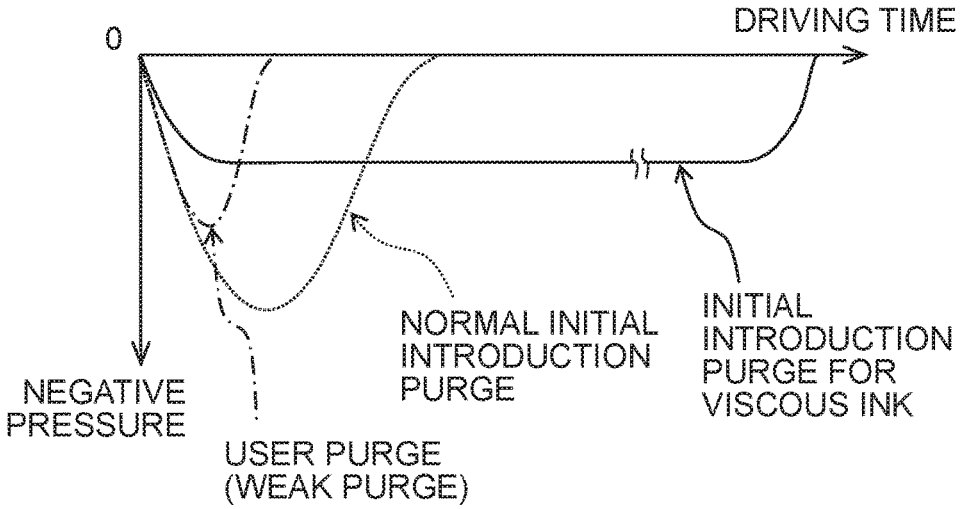
FIG. 6 is a view indicating the relationship between the negative pressure inside a black cap and a driving time of a suction pump in each of a normal initial introduction purge, an initial introduction purge for viscous ink, and a user purge.

The normal initial introduction purge is an initial introduction purge capable of introducing the ink inside the ink cartridge 42 up to the nozzles 46 of the intra-head channel 80 in a case that the sedimentation amount of the pigment which settles in the bottom portion of the ink cartridge 42 is less than a predetermined amount. Note that in the normal initial introduction purge, the CPU 101 controls the suction pump 51 such that a negative pressure, capable of discharging (jetting) the air remaining in the intra-head channel 80 together with the liquid inside the intra-head channel 80 from the nozzles 46, is generated in the black cap portion 55*a*. Specifically, in the normal initial introduction purge, the CPU 101 controls the suction pump 51 so that a negative pressure greater than that generated in the initial introduction purge for viscous ink is generated in the black cap portion 55*a*, as depicted in FIG. 6. With this, when the normal initial introduction purge is performed, the liquid inside the intra-head channel 80 is consequently moved at a fast flow rate, and thus the air remaining in the intra-head channel 80 can also be jetted or discharged efficiently from the nozzles 46.

Regarding the initial introduction purge for the color pigment inks, although any detailed explanation will be omitted, the pigments in the color pigment inks are less likely to settle than the pigment in the black pigment ink, and thus it is made possible to cause the maintenance unit 9 to execute only an initial introduction purge similar to the normal initial introduction purge.

On the other hand, the initial introduction purge for viscous ink is a purge which is executed in a case that the sedimentation amount of the pigment which settles in the bottom portion of the ink cartridge 42 is not less than the predetermined amount and that the ink cannot be appropriately introduced to the inside of the intra-head channel 80 with the normal initial introduction purge. Namely, the initial introduction purge for viscous ink is a purge capable of jetting the pigment ink in a larger amount than that in the normal initial introduction purge, in the case that the sedimentation amount of the pigment which settles in the bottom portion of the ink cartridge 42 is not less than the predetermined amount.

In the initial introduction purge for viscous ink, the CPU 101 controls the rotation speed of the suction pump 51 such that the conveyance pressure (suction force of the suction pump 51) applied to the pigment ink is weaker than that in the normal initial introduction purge, namely, such that the peak of the negative pressure generated in the black cap portion 55*a* becomes lower than that in the normal initial introduction purge. The reason therefor is as follows.

As described above, in a case that the initial introduction purge for viscous ink is performed, the pigment concentration of the pigment ink becomes locally great in the bottom portion of the ink cartridge 42 and the viscosity of the black pigment ink is also increased in the bottom portion of the ink cartridge 42. Accordingly, in such a case that, in the initial introduction purge for viscous ink, the conveying pressure applied to the pigment ink is made to be same as that applied to the pigment ink in the normal initial introduction purge, the pressure drop becomes great due to the high viscosity of the pigment ink. Further, since the amount of the fluid sucked by the pump 51 per unit time becomes greater than the conveyance amount of the pigment ink conveyed from the ink cartridge 42 toward the nozzles 46 per unit time, the negative pressure inside the black cap portion 55*a* consequently continues to rise. In addition, since the amount of the settled ink or sedimentary ink (highly viscous ink) as an object to be sucked in the initial introduction purge for viscous ink is great, the driving time during which the suction pump 51 is driven (activated) needs to be made longer than that in a case of performing the normal initial introduction purge. As a result, the negative pressure in the black cap portion 55*a* is greatly increased, thus leading to such a possibility that the black cap portion 55*a* is deformed and that the sealability in the black cap portion 55*a* might be lost, which in turn might make it impossible to execute the purge normally.

For the reasons stated above, in the initial introduction purge for viscous ink, the conveyance pressure applied to the pigment ink is made to be weaker than that in the normal initial introduction purge. By doing so, the flow rate of the pigment ink in the entire ink channel 85 in the initial introduction purge for viscous ink can be made to be slow, and thus the pressure drop can be made small. In addition, since it is possible to made the difference, between the amount of the fluid sucked by the suction pump 51 per unit time and the conveyance amount of the pigment ink conveyed from the ink cartridge 42 toward the nozzles 46 per unit time, to be small, it is possible to suppress any great increase in the negative pressure in the black cap portion 55*a*. As a result, the pigment ink of which pigment concentration is locally high in the ink cartridge 42 due to the settlement (sedimentation) of the pigment can be discharged (jetted) from the nozzles 46 more effectively and more assuredly. Note that in the present embodiment, as depicted in FIG. 6, the peak of the negative pressure generated in the black cap portion 55*a* in the initial introduction purge for viscous ink is smaller than the peak of the negative pressure generated (in the black cap portion 55*a*) in the weak purge of the user purge.

Further, in the embodiment, the CPU 101 controls the suction pump 51 in the initial introduction purge for viscous ink such that the rotation speed of the suction pump 51 is lowered after a predetermined time has elapsed since the start of the initial introduction purge for viscous ink. Specifically, the CPU 101 drives the suction pump 51 at a high rotation speed so as to increase the negative pressure inside the black cap portion 55*a* since the start of the purge and until the predetermined time elapses, and then the CPU 101 drives the suction pump 51 at a lowered rotation speed after the predetermined time has elapsed so as to maintain the negative pressure inside the black cap portion 55*a*, without allowing the negative pressure to be increased. With this, it is possible to suppress any excessive increase in the negative pressure in the black cap portion 55*a*, in an ensured manner.

Next, an explanation will be given about a setting method for setting the driving time of the suction pump 51 in the initial introduction purge for viscous ink. As described above, since the conveyance pressure applied to the pigment ink is weaker in the initial introduction purge for viscous ink than that in the normal initial introduction ink, the CPU 101 makes the driving time of the suction pump 51 to be longer than that in the normal initial introduction purge.

Further, in the initial introduction purge for viscous ink, the CPU 101 sets the driving time of the suction pump 51, such that the driving time is made to be longer as the sedimentation amount of the pigment ink is greater, with the elapsed time elapsed since the shipment time of the ink cartridge 42 up to the current time, the temperature of the ink cartridge 42, and the volume (capacity) of the ink cartridge 42 as the setting parameters.

Specifically, the sedimentation amount of the pigment which settles in the ink cartridge 42 becomes greater as the period of time during which the ink cartridge 42 is allowed to stand still is longer. In view of this, the CPU 101 obtains information regarding the current time (current time information) inputted by the user via the user interface 90, and information regarding the shipment time (shipment time information) of the ink cartridge 42 which is stored in the memory 142 of the ink cartridge 42. Further, based on the obtained current time information and shipment time information, the CPU 101 makes the driving time of the suction pump 51 in the initial introduction purge for viscous ink to be longer as the elapsed time elapsed since the shipment time of the ink cartridge and up to the current time is longer. Namely, under a condition that the temperature of the ink cartridge 42 is same and that the volume of the ink cartridge 42 is same, the CPU 101 makes the driving time of the suction pump 51 to be longer as the elapsed time elapsed since the shipment time of the ink cartridge 42 and up to the current time is longer.

Note that in such a case that the ink cartridge 42 has been vibrated (shaken) by the user during a time period since the shipment time up to the current time, there is such a possible case that an actual sedimentation amount might be smaller than a presumed sedimentation amount and that the ink might be wastefully jetted from the nozzles 46 by making the driving time of the suction pump 51 to be long. However, the embodiment makes it a main object thereof to jet a pigment ink of which pigment concentration is locally high in the ink cartridge 42 from the nozzles 46 in an assured manner. For this object, the driving time of the suction pump 51 is set in view of such a case that the ink cartridge 42 has not been vibrated by the user during the time period since the shipment time up to the current time, thereby lowering such a possibility that any no-discharge nozzle might be generated after the initial introduction purge for viscous ink.

Further, since the viscosity of the pigment ink becomes lower as the temperature of the ink cartridge 42 is higher, the settlement (sedimentation) of the pigment is promoted. Accordingly, in the embodiment, the CPU 101 presumes that the temperature since the shipment time of the ink cartridge 42 and up to the current time is a temperature which can be obtained based on the parameter currently obtained by the temperature sensor 91; and the CPU 101 makes the driving time of the suction pump 51 in the initial introduction purge for viscous ink to be longer as the said temperature is higher. Namely, under a condition that the elapsed time elapsed since the shipment time of the ink cartridge 42 up to the current time is same and that the volume of the ink cartridge 42 is same, the CPU 101 makes the driving time of the suction pump 51 to be loner as the temperature of the ink cartridge 42 is higher. Note that in such a case that the actual temperatures of the ink cartridge 42 since the shipment time up to the current time can be obtained, the driving time of the suction pump 51 may be set based on the obtained temperatures.

Furthermore, as described above, each of the cartridge installing sections 41 is capable of selectively installing a plurality of kinds of the ink cartridge 42 of which volumes are mutually different. Since the large volume ink cartridge 42*b* stores a larger volume of the pigment ink than the small volume ink cartridge 42*a*, the amount of the pigment is grater in the large volume ink cartridge 42*b* corresponding to the extent of the largeness of the pigment ink amount as compared to that of the small volume ink cartridge 42*a*. Moreover, the base area (the area of the base) of the small volume ink cartridge 42*a* (small volume storage chamber 44*a*) is same as that of the large volume ink cartridge 42*b* (large volume storage chamber 44*b*). Accordingly, the pigment is more likely to settle in a greater volume in the large volume ink cartridge 42*b* having a larger volume than in the small volume ink cartridge 42*a*, and thus the pigment ink of which pigment concentration is increased due to the sedimentation (settlement) of the pigment is consequently present in an area from the bottom surface up to a higher position in the large volume ink cartridge 42*b*, than in the small volume ink cartridge 42*a*. In view of the above situation, in the embodiment, the CPU 101 reads out volume information regarding the volume of the ink cartridge 42 which is stored in the memory 142 of the ink cartridge 42; in a case that the volume information indicates that the ink cartridge 42 is a large volume ink cartridge 42*b*, the CPU 101 makes the driving time of the suction pump 51 in the initial introduction purge for viscous ink to be longer than in a case that the volume information indicates that the ink cartridge 42 is a small volume ink cartridge 42*a*. Namely, under a condition that the temperature of the ink cartridge 42 is same and that the elapsed time elapsed since the shipment time of the ink cartridge 42 up to the current time is same, the CPU 101 makes the driving time of the suction pump 51 to be longer in the case that the ink cartridge 42 is the large volume ink cartridge 42*b* than in the case that the ink cartridge 42 is the small volume ink cartridge 42*a*.

As described above, by allowing the CPU 101 to set the driving time of the suction pump 51 in the initial introduction purge for viscous ink based on the current time information and shipment time information, the volume information, and the parameter obtained from the temperature sensor 91, the pigment ink of which pigment concentration is locally high in the ink cartridge 42 can be jetted or discharged from the nozzles 46 in an assured manner.

The initial introduction purge for viscous ink as explained above is executed only in a case that the CPU 101 obtains sedimentation information regarding the sedimentation amount of the pigment in the ink cartridge 42 and that the CPU 101 judges that the sedimentation amount of the pigment in the ink cartridge 42 is not less than the predetermined amount based on the sedimentation information.

Specifically, when the CPU 101 causes the maintenance unit 9 to perform the initial introduction purge, the CPU 101 firstly causes the maintenance unit 9 to execute the normal initial introduction purge. Then, the CPU 101 controls the head 5, the carriage driving motor 20, etc., to print the above-described test pattern for checking non-jetting nozzle (for checking nozzle-slip out) on a paper P. Afterwards, the CPU 101 causes the result of printing of the test pattern to be evaluated by the user, via the user interface 90, on the four scales that are L1 to L4, and the CPU 101 obtains evaluation information regarding the evaluation made by the user as the above-described sedimentation information. As described above, since the user can input the sedimentation information (evaluation information) by seeing the test pattern printed on the paper P after the normal initial introduction purge, the reliability of the sedimentation information can be further enhanced. As a modification of the embodiment, it is also allowable that the user inputs the evaluation information (sedimentation information) via a user interface provided on the external apparatus 31, and that the CPU 101 is configured to obtain the evaluation information from the external apparatus 31.

Here, in a case that the sedimentation amount of the pigment in the ink cartridge 42 is less than the predetermined amount, there is such a possibility that the evaluation of the user with respect to the printing result of the test pattern printed after the execution of the normal initial introduction purge might be any one of the four scales of L1 to L4. This is because in a case that the normal initial introduction purge functions normally and that the air does not remain in the intra-head channel 80, there is a low possibility that any non-jetting nozzle might be generated and there is a high possibility that the evaluation of the user might be L1. On the other hand, in another case that the normal initial introduction purge does not function normally and/or that a large amount of the air remains in the intra-head channel 80, there is such a possibility that the non-jetting nozzle might be generated in a large number, which in turn might result in the evaluation of the user becoming any one of L2 to L4, as well.

On the other hand, in a case that the sedimentation amount of the pigment in the ink cartridge 42 is not less than the predetermined amount, there is a high possibility that even if the normal initial introduction purge is executed, the pigment ink might not be introduced up to the nozzles 46 as the distal end of the intra-head channel 80; and there is a remarkably higher possibility that the evaluation by the user of the test pattern printed thereafter might be the scale L4, than the possibility that the evaluation of the user might become any one of the remaining scales L1 to L3.

Further, as described above, the sedimentation amount of the pigment which settles in the ink cartridge 42 becomes larger as the period of time during which the ink cartridge 42 is allowed to stand still is longer. Accordingly, in a case that the elapsed time elapsed since the shipment time of the ink cartridge 42 up to the current time is less than the predetermined time (for example, six months), there is such a possibility that the sedimentation amount of the pigment which settles in the ink cartridge 42 might be less than the predetermined amount, even if the evaluation of the user with respect to the result of printing of the test pattern is L4. In view of this, the CPU 101 obtains the current time information inputted by the user via the user interface 90 and the shipment time information read out from the memory 142 of the ink cartridge 42, as the above-described sedimentation information.

Then, based on user evaluation information, the current time information and the shipment time information which are obtained by the CPU 101 as the sedimentation information, the CPU 101 judges that the sedimentation amount of the pigment which settles in the ink cartridge 42 is not less than the predetermined amount in a case that the evaluation of the result of printing of the test pattern by the user is L4 and that the elapsed time elapsed since the shipment time of the ink cartridge 42 up to the current time is not less than the predetermined time, whereas the CPU 101 judges that the sedimentation amount of the pigment which settles in the ink cartridge 42 is less than the predetermined amount in any case different from the above-described case. Further, in the case that the CPU 101 judges that the sedimentation amount of the pigment which settles in the ink cartridge 42 is not less than the predetermined amount, the CPU 101 causes the maintenance unit 9 to execute the initial introduction purge for viscous ink. By obtaining the user evaluation information, the current time information and the shipment time information as the sedimentation information as described above so as to judge whether or not the sedimentation amount of the pigment which settles in the ink cartridge 42 is not less than the predetermined amount, it is possible to appropriately perform the initial introduction purge for viscous ink.

Note that in a case that the ink cartridge 42 is vibrated by the user during the time period since the shipment time up to the current time, there is such a possibility that the sedimentation amount of the pigment which settles in the ink cartridge 42 is less than the predetermined amount even in such a case that the evaluation of the user with respect to the result of printing of the test pattern is L4 and that the elapsed time elapsed since the shipment time of the ink cartridge 42 up to the current time is not less than the predetermined time. Accordingly, in such a case, the initial introduction purge for viscous ink is consequently executed even if the initial introduction purge for viscous ink is not required. In the embodiment, however, the main object thereof is to jet (discharge) the pigment ink of which pigment concentration is locally high in the ink cartridge 42 from the nozzles 46 in an assured manner. Accordingly, there is presumed such a case that the ink cartridge is not vibrated by the user during the period since the shipment time of the ink cartridge 42 up to the current time, the judgement is made as to whether or not the sedimentation amount of the pigment which settles in the ink cartridge 42 is not less than the predetermined amount, thereby lowering such a possibility that any non-jetting nozzle is generated after the initial introduction purge for viscous ink.

As explained above, the present embodiment is capable of executing the two kinds of the initial introduction purge, the three kinds of the user purge, and the one kind of the maintenance purge, namely, a total of six kinds of the suction purge. The ROM 102 stores six kinds of control program corresponding to the six kinds of the suction purge, respectively. In a case that the CPU 101 executes a suction purge among the six respective kinds of the suction purge, the CPU 101 reads out a control program, among the six kinds of the control program, corresponding to the suction purge from the ROM 102 and executes the control program. In other words, in the present embodiment, the six kinds of the suction purge (hereinafter referred to as first to sixth purges) corresponding to the six kinds of the control program can be executed. The above-described two kinds of the initial introduction purge, three kinds of the user purge and one kind of the maintenance purge each correspond to any one of the first to sixth purges. Specifically, as depicted in FIG. 7, the first purge corresponds to the normal initial introduction purge, the second purge corresponds to the initial introduction purge for viscous ink, the third purge corresponds to the weak purge of the user purge, the fourth purge corresponds to the medium purge of the user purge, the fifth purge corresponds to the strong purge of the user purge, and the sixth purge corresponds to the maintenance purge.

<Operation of Ink-Jet Printer>

Figure 8A:
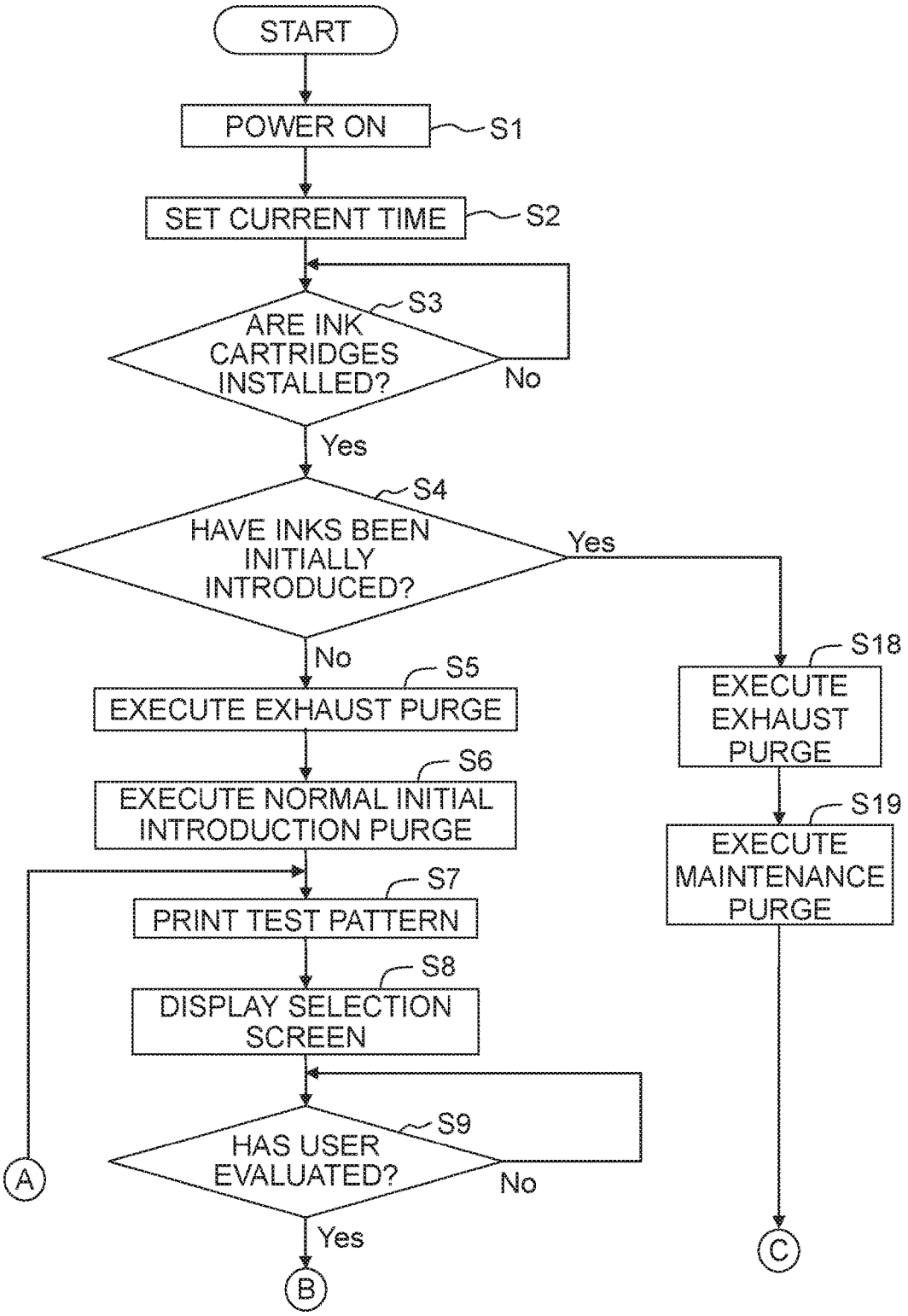
FIGS. 8A and 8B depict a flowchart for explaining a processing operation of the ink-jet printer.
Figure 8B:
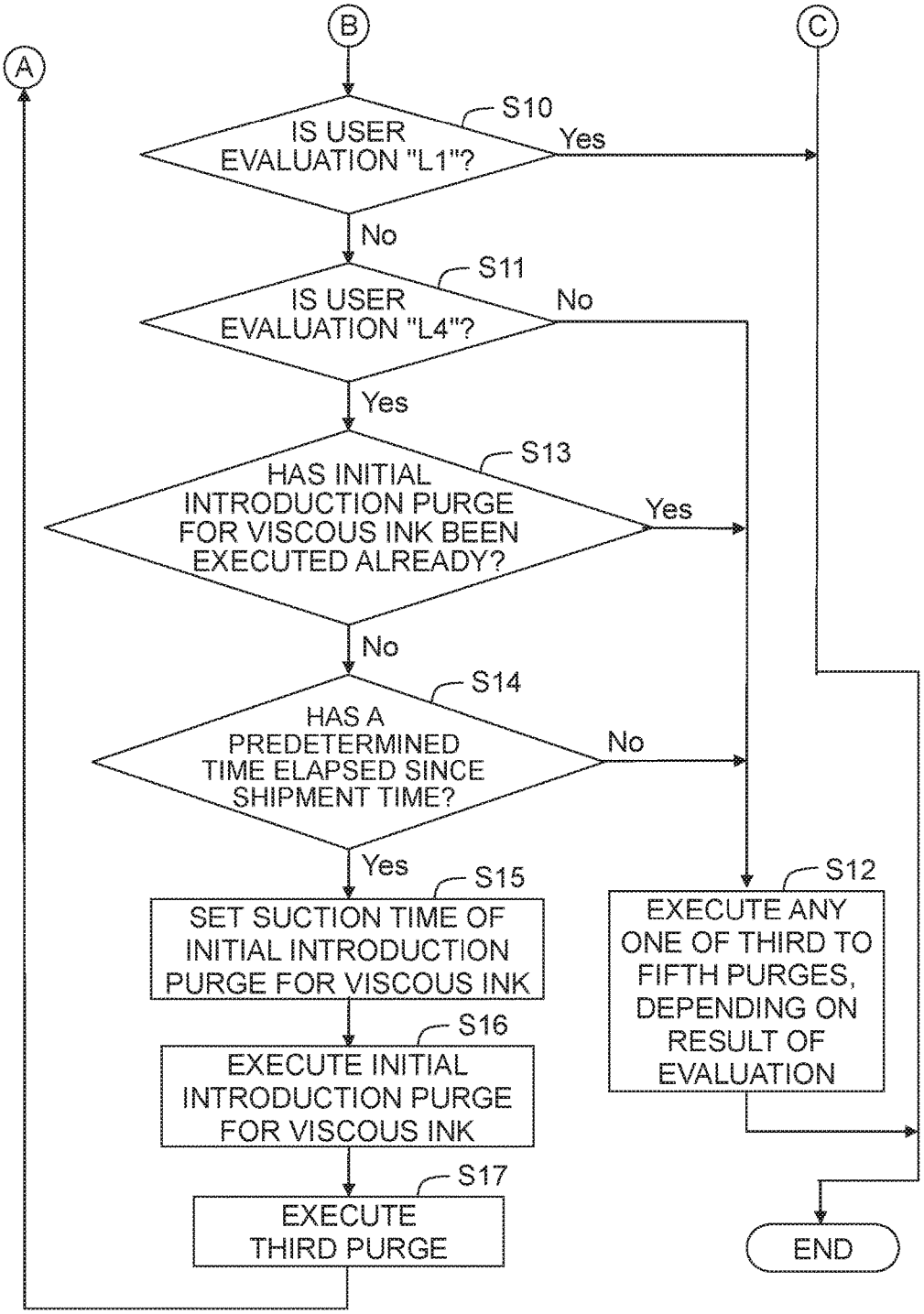

Next, an explanation will be given about an example of a processing operation performed by the printer 1 in a case that the power source of the printer 1 is switched ON by the user, with reference to FIGS. 8A and 8B. Note that, however, in the following, the processing operation of the suction purge regarding the black pigment ink will be explained, while any explanation regarding the processing operation of the suction purge regarding the color pigment ink(s) will be omitted.

At first, when the power source of the printer 1 is switched ON by the user (S1), the CPU 101 obtains the current time from the user via the user interface 90 and sets the current time (S2). Next, the CPU 101 judges whether or not the ink cartridge 42 is installed in the cartridge installing section 41, respectively, based on the result of detection from the installation detecting sensor 152 (S3). In a case that the CPU 101 judges that the ink cartridge 42 is not installed in the cartridge installing section 41 (S3: NO), the CPU 101 causes the display 90*b* to display a screen urging the user to install the ink cartridge 42 in the cartridge installing section 41 after shaking (vibrating) the ink cartridge 42 a plurality of times, and then the CPU 101 returns to the processing of Step S3.

On the other hand, in a case that the CPU 101 judges that the ink cartridge 42 is installed in the ink cartridge section 41 (S3: YES), the CPU 101 refers to the RAM 103 and judges whether or not the ink has been initially introduced already in each of the intra-head channels 80 of the head 5 mounted on the carriage 3 (S4). Specifically, the RAM 103 stores an introduction flag indicating whether or not the ink has been initially introduced. In a case that the introduction flag is ON, the CPU 101 judges that the ink has been initially introduced. On the other hand, in another case that the introduction flag is OFF, the CPU 101 judges that the ink has not been introduced yet (non-introduction of the ink).

Then, in the case that the CPU 101 judges that the ink has not been initially introduced yet (S4: NO), the CPU 101 judges that the initial introduction of the ink is to be executed form each of the ink cartridges 42 and into one of the intra-head channels 80, and the CPU 101 firstly causes the maintenance unit 9 to execute the exhaust purge (S5: Exhaust Processing (Exhaust Purge)). Specifically, in a state that the exhaust cap 56 is connected to the exhaust portions 23 and that the valve inside each of the exhaust portions 23 is opened by the opening/closing member 27, the CPU 101 communicates the suction pump 51 to the exhaust cap 56 by the switching device 52 and then the CPU 101 drives the suction pump 51. By executing the exhaust purge, the air in each of the four intra-head channels 80 corresponding to the four color pigment inks respectively is exhausted (discharged) to the outside of each of the intra-head channels 80, thereby making it possible to suppress any deterioration or lowering of the jetting characteristic of the inks which would be otherwise caused by the air present in these intra-head channels 80.

Next, the CPU 101 causes the maintenance unit 9 to execute the normal initial introduction purge (first purge) so as to introduce the ink from an ink cartridge 42, among the ink cartridges 42, which stores the black pigment ink into the intra-head channel 80 (S6: First Purge Processing). Specifically, the CPU 101 drives the suction pump 51 in a state that the nozzles 46*a* are covered with the nozzle cap 55 and that the black cap portion 55*a* is communicated with the suction pump 51. In this situation, the CPU 101 switches the introduction flag stored in the RAM 103 from OFF to ON. Although any illustration is omitted in the drawings, the CPU 101 then causes the maintenance unit 9 to perform also the initial introduction purge for introducing the three pigment color inks into three intra-head channels 80, among the four intra-head channels 80, from the three ink cartridges 42 which store the three color pigment inks, respectively.

Next, the CPU 101 controls the head 5, the carriage driving motor 20, etc. so as to print the test pattern for checking non-jetting nozzle on a paper P (S7: Pattern Printing Processing). Afterwards, the CPU 101 causes the display 90*b* to display a screen for causing the user to evaluate the result of printing of the test pattern by the user on the four scales of L1 to L4 (S8), and the CPU 101 stands by until the CPU 101 receives the user evaluation information from the user via the operation keys 90*a* (S9).

Then, in a case that the CPU 101 obtains the user evaluation information (S9: YES), the CPU 101 judges whether or not the evaluation of the user regarding the result of printing of the test pattern, indicated by the user evaluation information, is L1 (S10). In a case that the CPU 101 judges that the evaluation of the user is L1 (S10: YES), the CPU 101 judges that any no-jetting nozzle is generated, and ends this processing operation.

On the other hand, in a case that the CPU 101 judges that the evaluation of the user is not L1 (S10: NO), the CPU 101 judges whether or not the evaluation of the user regarding the result of printing of the test pattern is L4 (S11). In a case that the CPU 101 judges that the evaluation of the user is not L4 (S11: NO), the CPU 101 causes the maintenance unit 9 to perform the third purge under a condition that the evaluation of the user is L2, or causes the maintenance unit 9 to perform the fourth purge under a condition that the evaluation of the user is L3, and then ends this processing operation.

On the other hand, in a case that the CPU 101 judges that the evaluation of the user is L4 (S11: YES), the CPU 101 refers to the RAM 103 so as to judge whether or not the initial introduction purge for viscous ink has been already executed (S13). Specifically, a flag for initial introduction purge for viscous ink indicating whether or not the initial introduction purge for viscous ink has been already executed is stored in the RAM 103. The CPU 101 judges that the initial introduction purge for viscous ink has been already executed, under a condition that the flag for initial introduction purge for viscous ink is ON. On the other hand, the CPU 101 judges that the initial introduction purge for viscous ink has not been executed yet, under a condition that the flag for initial introduction for viscous ink is OFF.

In a case that the CPU 101 judges that the initial introduction purge for viscous ink has been already executed (S13: YES), the CPU 101 judges that the pigment ink has been already introduced up to the vicinity of the nozzles 46 as the distal end of the intra-head channel 80 by the initial introduction purge for viscous ink which was previously executed; the CPU 101 causes the maintenance unit 9 to perform the fifth purge, in accordance with the evaluation of the user that the result of printing of the test pattern is L4, and the CPU 101 ends this processing operation.

On the other hand, in a case that the CPU 101 judges that the initial introduction purge for viscous ink has not been executed yet (S13: NO), the CPU 101 judges whether or not the elapsed time elapsed since the shipment time up to the current time is not less than the predetermined time, based on the current time information obtained in Step S2 and based on the shipment time information obtained from the memory 142 of the ink cartridge 42 (S14). In a case that the CPU 101 judges that the elapsed time elapsed since the shipment time up to the current time is less than the predetermined period (S14: NO), the CPU 101 judges that the sedimentation amount of the pigment which settles in the ink cartridge 42 is less than the predetermined amount, causes the maintenance unit 9 to perform the fifth purge, based on the evaluation of the user that the result of printing of the test pattern is L4 (S12), and ends this processing operation.

On the other hand, in a case that the CPU 101 judges that the elapsed time elapsed since the shipment time up to the current time is not less than the predetermined period (S14: YES), the CPU 101 judges that the sedimentation amount of the pigment which settles in the ink cartridge 42 is not less than the predetermined amount. Then, the CPU 101 sets the driving time of the suction pump 51 at the time of (to be adopted when performing) the initial introduction purge for viscous ink, based on the volume information and the shipment time information stored in the memory 142 of the ink cartridge 42, the current time information obtained in Step S2, and the parameter obtained from the temperature sensor 91 (S15).

Afterwards, the CPU 101 causes the maintenance unit 9 to execute the initial introduction purge for viscous ink (second purge) (S16: initial introduction purge for viscous ink). Specifically, the CPU 101 drives the suction pump 51 only for a driving time set in the above-described Step S15 in a state that the nozzles 46*a* are covered with the nozzle cap 55 and that the black cap portion 55*a* is communicated with the suction pump 51. In this situation, the CPU 101 switches the flag for initial introduction purge for viscous ink which is stored in the RAM 103 from OFF to ON.

Note that in the initial introduction purge for viscous ink performed in the processing of Step S16, the conveyance pressure (suction force of the suction pump 51) applied to the pigment ink in the entire ink channel 85 is weaker than that in the normal initial introduction purge. Accordingly, even if the initial introduction purge for viscous ink is performed, the flow rate of the liquid in the entire ink channel 85 is slow, which in turn results in such a fear that a large amount of the air might remain in the intra-head channel 80. In view of such a fear, the CPU 101 in the present embodiment causes the maintenance unit 9 to execute the third purge corresponding to the weak purge, after executing the processing of S16 (S17). By doing so, it is possible to jet (discharge) the air remaining in the intra-head channel 80 together with the pigment ink in the intra-head channel 80, which in turn makes it possible to suppress any deterioration in the jetting characteristic of the ink, as a result. Note that also in a case that the fourth purge corresponding to the medium purge or the fifth purge corresponding to the strong purge were performed, as the purge to be performed after the initial introduction purge for viscous ink, the air remaining inside the intra-head channel 80 can be jet (discharged) from the nozzles 46. However, the main purpose of this purge is to lower the air remaining inside the intra-head channel 80, and thus if the fourth or fifth purge is performed, there is such a possibility that the ink might be jetted from the nozzles 46 unnecessarily. Accordingly, it is most appropriate that the third purge is adopted as the user purge to be performed after the initial introduction purge for viscous ink. When the CPU 101 ends the processing of Step S17, the CPU 101 returns to the processing of Step S7.

On the other hand, in a case that the CPU 101 judges in the processing of Step S4 that the ink has been already initially introduced (S4: YES), the CPU 101 causes the maintenance unit 9 to perform the exhaust purge (S18), and then causes the maintenance unit 9 to perform the maintenance purge (sixth purge)(S19). By these exhaust purge and maintenance purge, the jetting characteristic of the nozzles 46 is restored. The operation of the printer 1 has been explained as above.

According to the above-described present teaching, even in a case that the sedimentation amount of the pigment in the inside the ink cartridge 42 is not less than the predetermined amount, the maintenance unit 9 is caused to execute the initial introduction purge for viscous ink to thereby make it possible to discharge or jet, from the nozzles 46, the pigment ink of which pigment concentration is locally increased in the ink cartridge 42 due to the sedimentation of the pigment, and to smoothly introduce the pigment ink to the inside of the intra-head channel 80. As a result, it is possible to suppress any occurrence of the jetting failure of the ink in the head 5. On the other hand, in such a case that the sedimentation amount of the pigment in the inside the ink cartridge 42 is less than the predetermined amount, only the normal initial introduction purge processing is executed, thereby making it possible to suppress the consumption amount of the ink.

Further, in the embodiment, the maintenance unit 9 is caused to perform the exhaust purge before the normal initial introduction purge. By the exhaust purge, the air is exhausted from each of the four intra-head channels 80, which consequently causes a small amount of the pigment ink to be introduced into each of the four entire ink channels 80 from one of the ink cartridges 42. In this situation, in a case that the sedimentation amount of the pigment in the ink cartridge 42 which stores the black pigment ink is not less than the predetermined amount, there arises a difference between the introduction amount of the black pigment ink into the entire ink channel 85 and the introduction amount of each of the color pigment inks into one of the entire ink channels 85. Accordingly, in such a case that the normal initial introduction purge regarding the color pigment inks and the normal initial introduction purge regarding the black pigment ink are performed afterwards, with a similar processing for the former and the latter, there arises such a possibility that the pigment color inks are introduced into the entirety of the entire ink channels 85, whereas the black pigment ink might not be introduced up to the nozzles 46 as the distal end of the entire ink channel 85, in some cases. In the embodiment, however, the initial introduction purge for viscous ink is executed even for such a case, thereby making it possible to introduce the black pigment ink up to the nozzles 46 as well.

In addition, since the discharge pipe 45, in the ink cartridge 42*b*, to which the needle 41*a* is connected is connected to a lower portion of each of the storage chambers 44*a* and 44*b*, the pigment ink of which pigment concentration is high and which is present in the vicinity of the lower portion of each of the storage chambers 44*a* and 44*b* can be jetted from the nozzles 46 efficiently.

In the embodiment as explained above, the ink cartridge 42 corresponds to a "tank", and the maintenance unit 9 corresponds to a "purge mechanism"; the user interface 90 corresponds to a "user information obtaining section", and the scanner unit 92 corresponds to an "image analyzing mechanism"; the black cap portion 55*a* corresponds to a "suction cap"; the sub tank 14 and the exhaust portion 23 correspond to a "channel structure"; the discharge pipe 45 corresponds to a "liquid discharge port"; and the nozzles 46 belonging to the nozzle row 47K correspond to "first nozzles" and the nozzles 46 belonging to the nozzles rows 47Y, 47M and 47C correspond to "second nozzles". The black pigment ink corresponds to a "first pigment ink" and the ink cartridge 42, among the ink cartridges 42, which stores the black pigment ink corresponds to a "first tank", and the supply channel 62 to which the ink is supplied from the ink cartridge 42 storing the black pigment ink corresponds to a "first liquid channel". Further, each of the color pigment inks corresponds to a "second pigment ink" and each of the ink cartridges 42, among the ink cartridges 42, which stores one of the color pigment inks corresponds to a "second tank", and the supply channel 62 to which the ink is supplied from each of the ink cartridges 42 storing one of the pigment color inks corresponds to a "second liquid channel".

Next, an explanation will be given about modifications in which various kinds of changes are added to the above-described embodiment.

In the above-described embodiment, the CPU 101 obtains the user evaluation information, the current time information and the shipment time information as the sedimentation information. It is allowable, however, that the CPU 101 may obtain only the user evaluation information or that the CPU 101 may obtain only the current time information and the shipment time information. Further, the sedimentation information is not limited to those described above; it is sufficient that the sedimentation information is information regarding the sedimentation amount of the pigment in the ink cartridge 42. For example, it is allowable that a sensor capable of directly detecting the sedimentation amount of the pigment inside the ink cartridge 42 is provided, and that the result of detection by this sensor is made to be the sedimentation amount. In addition, it is allowable that a parameter regarding the temperature of the ink cartridge 42 obtained from the temperature sensor 91 and/or volume information stored in the memory 142 of the ink cartridge 42 are/is made to be the sedimentation information. Further, it is not necessarily indispensable that the sedimentation information obtained from the user via the user interface 90 is the evaluation of the user with respect to the result of the printing of the test pattern.

Note that the sensor capable of directly detecting the sedimentation amount of the pigment inside the ink cartridge 42 can be exemplified by an optical sensor including a light-emitting element such as a photo diode and a light-receiving element such as a photo interrupter. It is possible to arrange the light-emitting element and the light-receiving element at a lower portion of the ink cartridge 42 so as to sandwich the ink cartridge 42 between the light-emitting element and the light-receiving element. As the sedimentation amount of the pigment in the ink is greater, the light transmittance of the ink becomes lower. Accordingly, even if the light-emitting element of the optical sensor emits a light in a predetermined light amount, the light amount received by the light-receiving element is decreased. By investigating the relationship between the light amount received by the light-receiving element and the sedimentation amount of the pigment, it is possible to presume the sedimentation amount of the pigment from the light amount received by the light-receiving element of the optical sensor.

Further, in the above-described embodiment, the user evaluation information, with respect to the test pattern printed on the paper P after the normal initial introduction purge, which is inputted via the user interface 90 is obtained as the sedimentation information. However, it is also allowable to cause the scanner unit 92 to analyze the test pattern and that the result of analysis is obtained as the sedimentation information. In the following, an example of a processing operation of the printer 1 according to this modification will be explained with reference to FIGS. 9A and 9B.

Figure 9A:
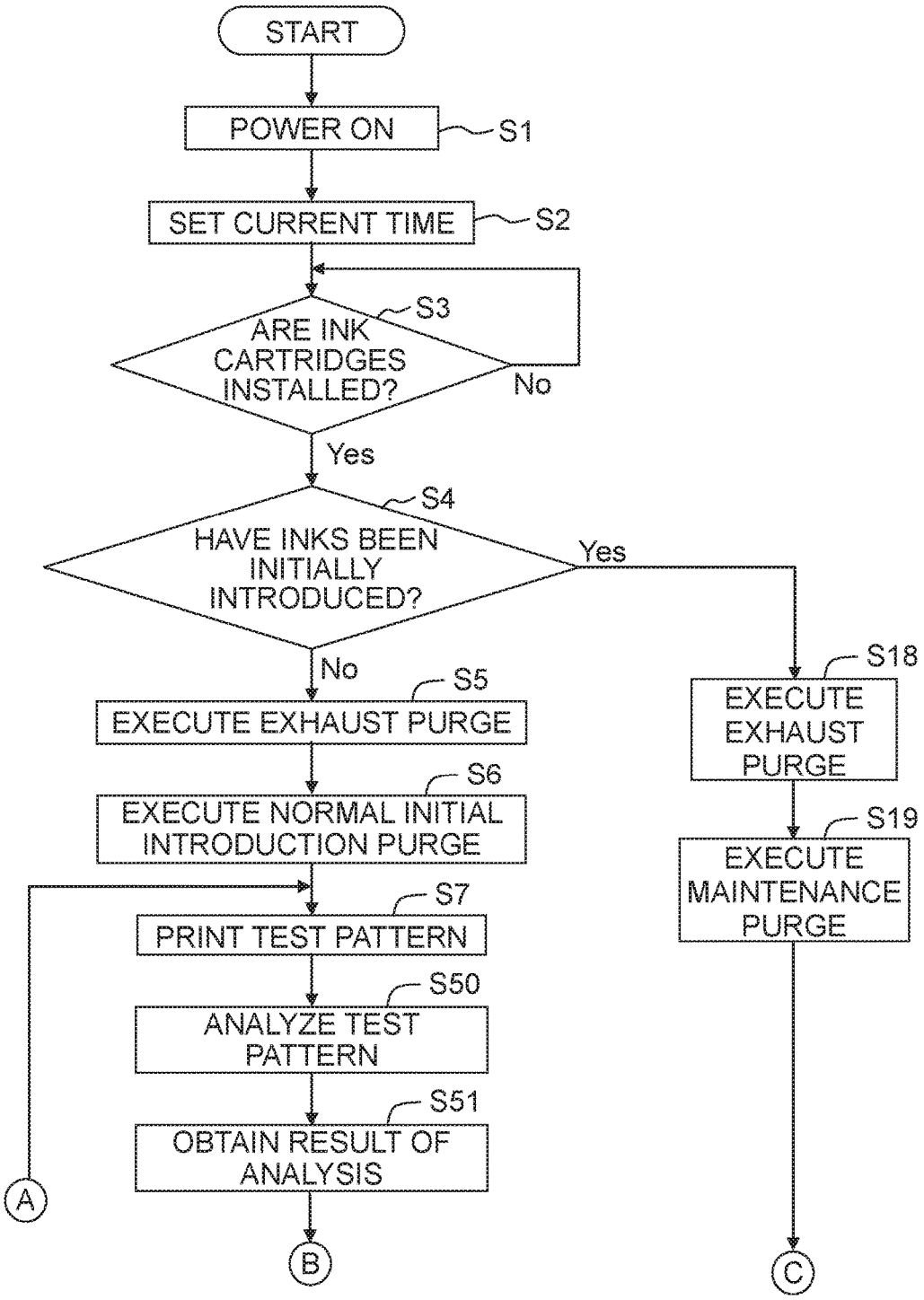
FIGS. 9A and 9B depict a flowchart for explaining a processing operation of the ink-jet printer, according to a modification.
Figure 9B:
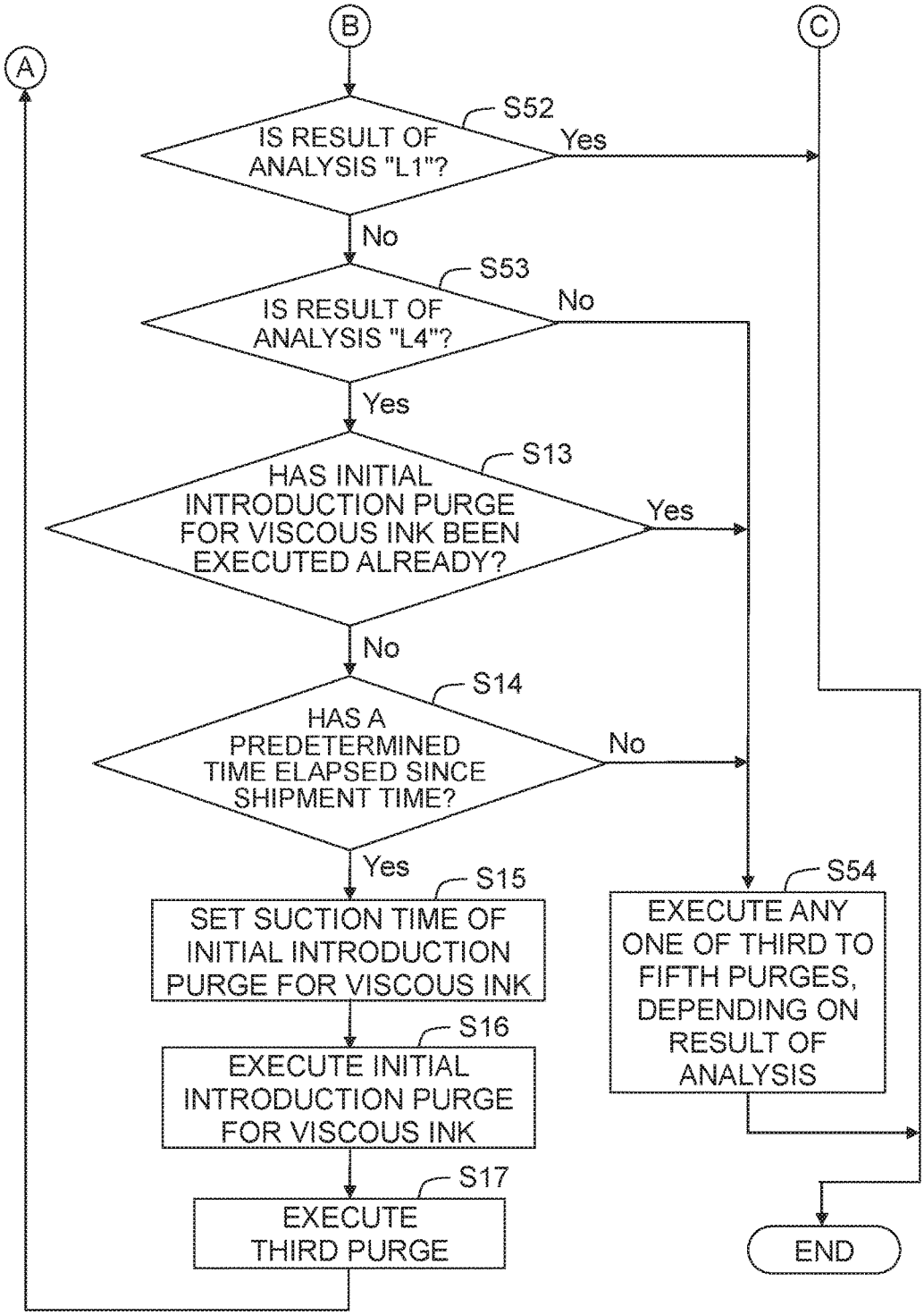

In this modification, as depicted in FIGS. 9A and 9B, after the test pattern for checking non-jetting nozzle has been printed on a paper P in the processing of Step S7, the CPU 101 causes the scanner unit 92 to analyze the test pattern (S50). Also in the analysis of the test pattern by the scanner unit 92, the CPU 101 causes the scanner unit 92 to evaluate the result of printing of the test pattern on the four scales of L1 to L4. After that, the CPU 101 obtains the result of analysis of the test pattern from the scanner unit 92 (S51), and the CPU 101 judges whether or not the evaluation, in the result of analysis, regarding the result of printing of the test pattern is L1 (S52). In a case that the CPU 101 judges that the evaluation is L1 (S52: YES), the CPU 101 ends this processing operation.

On the other hand, in a case that the CPU 101 judges that the evaluation is not L1 (S52: NO), the CPU 101 judges whether or not the evaluation, in the result of analysis, regarding the result of printing of the test pattern is L4 (S53). In a case that the CPU 101 judges that the evaluation is not L4 (S53: NO), the CPU 101 causes the maintenance unit 9 to perform any one of the third and fourth purges depending on the evaluation of the result of analysis, and ends this processing operation. On the other hand, in a case that the CPU 101 judges that the evaluation is L4 (S53: YES), the CPU 101 proceeds to the processing of Step S13. As described above, the present modification is capable of obtaining, as the sedimentation information, the result of analysis by the scanner unit 92 with respect to the test pattern printed on the paper P after the normal initial introduction purge. Accordingly, it is possible to further enhance the reliability of the sedimentation information.

In the above-described embodiment, in a case of performing the initial introduction for introducing the inks from the ink cartridges 42 to the intra-head channels 80, the CPU 101 firstly causes the maintenance unit 9 to perform the normal initial introduction purge. However, in a case that the CPU 101 can make judgement as to whether or not the sedimentation amount of the pigment which settles in the ink cartridge 42 is not less than the predetermined amount, based on the obtained sedimentation information, before performing this normal initial introduction purge, then it is allowable to cause the maintenance unit 9 to execute the initial introduction purge for viscous ink from the start, without causing the maintenance unit 9 to execute the normal initial introduction purge. Namely, before performing the initial introduction purge, the CPU 101 judges whether or not the sedimentation amount of the pigment which settles in the ink cartridge 42 is not less than the predetermined amount. Then, the CPU 101 may cause the maintenance unit 9 to execute the initial introduction purge selectively between the initial introduction purge for viscous ink and the normal initial introduction purge such that in a case that the CPU 101 judges that the sedimentation amount of the pigment which settles in the ink cartridge 42 is not less than the predetermined amount, the CPU 101 causes the maintenance unit 9 to execute the initial introduction purge for viscous ink, whereas in a case that the CPU 101 judges that the sedimentation amount of the pigment which settles in the ink cartridge 42 is less than the predetermined amount, the CPU 101 causes the maintenance unit 9 to execute the normal initial introduction purge. Further, also regarding the color pigment inks, in a case that the ink cartridges 42 are allowed to stand still for a long period of time, the pigment (s) settle(s) more or less in the ink cartridges 42. Therefore, as the initial introduction purge, the initial introduction purge for viscous ink may also be executable, in addition to the normal initial introduction purge. Although the driving time of the suction pump 51, which is adopted when the initial introduction purge for viscous ink is performed, is set based on the three setting parameters that are the elapsed time elapsed since the shipment time of the ink cartridge 42 up to the current time, the temperature of the ink cartridge 42 and the volume of the ink cartridge 42, it is also allowable to set the driving time based on any one of these three setting parameters, or may be set based on a parameter which is different from the three parameters.

Furthermore, the nozzle cap provided on the cap unit 50 may be a cap which commonly (collectively) covers all the nozzles 46 belonging to the nozzle rows 47K, 47Y, 47M and 47C. In such a case, in the suction purge, it is possible to allow the inks to be discharged (jetted) from all the nozzles 46 belonging to the nozzle rows 47K, 47Y, 47M and 47C at a time. Note that in this configuration, in a case that the sedimentation amount of the pigment in the ink cartridge 42 storing the black pigment ink is not less than the predetermined amount, there arises, as a result, a difference between the introduction amount of the black pigment ink into the entire ink channel 85 and the introduction amount of each of the color pigment inks into one of the entire ink channels 85. However, also in such a case, it is possible to allow also the black pigment ink to be introduced up to the nozzles 46 as the distal end of the entire ink channel 85, by executing the initial introduction purge for viscous ink.

Moreover, at the shipment time, it is not necessarily indispensable that the preservative solution is charged (filled) in the entire flow channel (path) in each of the intra-head channels 80; for example, it is allowable that the preservative solution is not charged in the dumper chamber 71 and in a channel on the side of the ink cartridge 42 with respect to the damper channel 71. Further, it is allowable that the preservative solution is not charged in each of the intra-head channels 80 at the time of the shipment.

Further, it is not necessarily indispensable to provide the exhaust channels 74 for performing the exhaust purge. Note that, however, in such a case that the exhaust channels 74 are not provided, all the air present in the intra-head channels 80 is required to be removed from the nozzles 46 as the distal end of the intra-head channels 80 only by the suction purge.

In addition, each of the cartridge installing sections 41 may be configured such that three or more kinds of the ink cartridge 42 of which volumes are mutually different are selectively installable in the cartridge installing section 41. Further, regarding the small volume ink cartridge 42*a* and the large volume ink cartridge 42*b* which are selectively installable with respect to the cartridge installing section 41, the base area (the area of the base) of the small volume ink cartridge 42*a* is same as that of the large volume ink cartridge 42*b*. However, the base area of the small volume ink cartridge 42*a* may be different from the base area of the large volume ink cartridge 42*b*. Also in this case, the sedimentation amount of the pigment which settles in the bottom portion of the ink cartridge 42*b* is still greater than that in the ink cartridge 42*a*. Note that in a case that the volumes of the ink cartridges 42 are same, the pigment ink of which pigment concentration becomes higher (is increased) due to the sedimentation of the pigment is consequently present up to a higher position from the bottom surface of the ink cartridge 42, as the base area of the ink cartridge 42 is smaller.

Furthermore, the present teaching is also applicable to a so-called on-carriage type printer in which a cartridge installing section in which an ink cartridge is installable is provided on the carriage. It is allowable that the discharge pipe 45 of the ink cartridge 42 is not connected to a lower portion of each of the storage chambers 44*a* and 44*b*; it is allowable, for example, that the discharge pipe 45 is connected to a middle or intermediate portion of each of the storage chambers 44*a* and 44*b*.

Moreover, in the above-described embodiment, although the purge for jetting the pigment ink from the nozzles 46 is the suction purge, it is allowable that the printer 1 is provided with a positive pressure imparting section configured to impart a positive pressure to the pigment ink in the ink cartridge 42, and that the suction purge may be a positive pressure purge for imparting the positive pressure with the positive pressure imparting section to the pigment ink in the ink cartridge 42 to thereby jet the pigment ink from the nozzles 46.

In addition, in the above-described embodiment, although the tank as the supply source of the ink is the ink cartridge, the tank is not limited to this. For example, it is allowable that the tank is a pouch-type ink storing bag formed of a flexible resin. This ink storing bag is provided with a cap to which the ink supply tube 22 is connectable; in a case that the ink supply tube 22 is connected to the cap, the ink inside the ink storing bag is allowed to flow through the ink supply tube 22.

In the embodiment as described above, the initial introduction purge is executed when the power source of the printer 1 having the head 5 mounted thereon is switched ON by the user for the first time after the printer 1 has been shipped from the factory and when the ink cartridges 42 are installed in the cartridge installing sections 41. However, the present disclosure is not limited by or restricted to such a case; the present disclosure is applicable also to a case that the printer 1, for which the initial introduction purge has been already executed, is conveyed or transported to another location and is re-installed in the another location. Before the printer 1 is transported, the ink cartridges 42 are detached (removed) from the cartridge installing sections 41, and the inks inside the intra-head channels 80 in the head 5 are discharged. In this situation, after discharging the inks inside the intra-head channels 80, it is also possible to charge the above-described preservative solution in the intra-head channels 80, as well. Further, after transporting the printer 1 to the another location, the ink cartridges 42 are installed in the cartridge installing sections 41, and the power source of the printer 1 is switched ON. Also in such a case, it is possible to execute an ink introduction purge for introducing the inks from the ink cartridges 42, in a similar manner as the initial introduction purge in the above-described embodiment.

Further, the present teaching is applicable also to a so-called line type ink-jet printer in which an image, etc. is printed, by an ink-jet head in a fixed state, on a sheet conveyed by a conveying mechanism.

What is claimed is:

1. An ink-jet printer comprising:

a tank configured to store a pigment ink;

a head which is connected to the tank, which has nozzles for jetting the pigment ink supplied from the tank;

a purge mechanism; and a controller configured to control the head and the purge mechanism to perform:

obtaining sedimentation information regarding a sedimentation amount of a pigment contained in the pigment ink in the tank;

judging whether or not the sedimentation amount of the pigment in the tank is not less than a predetermined amount, based on the obtained sedimentation information;

executing a first purge operation as an initial introduction purge processing for initially introducing the pigment ink from the tank to the head; and executing, as the initial introduction purge processing, a second purge processing capable of discharging, from the nozzles, the pigment ink in a larger amount than that in the first purge processing, in a case that the controller judges that the sedimentation amount is not less than the predetermined amount.

2. The ink-jet printer according to claim 1, wherein the controller is configured to obtain information regarding a shipment time of the tank and information regarding a current time, as the sedimentation information.

3. The ink-jet printer according to claim 1, wherein in the second purge processing, the controller controls the purge mechanism to apply, to the pigment ink, a conveying pressure which is weaker than a conveying pressure in the first purge processing, and so as to make a pressure applying time during which the conveying pressure is applied to the pigment ink to be longer than that in the first purge processing.

4. The ink-jet printer according to claim 3, wherein after the controller executes the second purge processing, the controller controls the purge mechanism to apply, to the pigment ink, a conveying pressure which is stronger than that in the second purge processing.

5. The ink-jet printer according to claim 1, wherein in the second purge processing, the controller controls the purge mechanism to apply, to the pigment ink, a conveying pressure such that a first pressure applying time, during which the conveying pressure is applied to the pigment ink in a case that an elapsed time elapsed since a shipment time of the tank up to a current time is a first time, is longer than a second pressure applying time during which the conveying pressure is applied to the pigment ink in a case that the elapsed time is a second time that is longer than the first time.

6. The ink-jet printer according to claim 1, further comprising a temperature sensor configured to obtain a parameter regarding temperature of the pigment ink in the tank, wherein in the second purge processing, the controller controls the purge mechanism to make a pressure applying time during which the conveying pressure is applied to the pigment ink to be long, based on the parameter obtained by the temperature sensor, in a case that the temperature of the tank is high.

7. The ink-jet printer according to claim 1, wherein the purge mechanism includes:

a suction cap configured to make contact with the head and to cover the nozzles; and a suction pump connected to the suction cap, wherein in the second purge processing, the controller lowers rotation speed of the suction pump after a predetermined time has elapsed since a processing start time of the second purge processing.

8. The ink-jet printer according to claim 1, further comprising a user interface configured to obtain information input by a user, wherein the controller obtains the sedimentation processing via the user interface.

9. The ink-jet printer according to claim 8, wherein in a case that the controller executes the initial introduction purge processing, the controller executes, before obtaining the sedimentation information:

the first purge processing; and a pattern printing processing for controlling the head to print a test pattern on a recording medium, after executing the first purge processing.

10. The ink-jet printer according to claim 1, further comprising a scanner configured to analyze an image on a recording medium, wherein in a case that the controller executes the initial introduction purge processing, the controller executes, before obtaining the sedimentation information:

the first purge processing; and a pattern printing processing for controlling the head to print a test pattern on the recording medium, after executing the first purge processing, and the controller obtains, as the sedimentation information, a result of analysis, by the scanner, of the test pattern printed on the recording medium.

11. The ink-jet printer according to claim 1, wherein the tank includes a plurality of individual tanks of which volumes are different from each other;

wherein the ink-jet printer further comprises:

tank installing sections each of which is capable of installing therein one of the plurality of individual tanks, each of the tank installing sections communicating one of the plurality of individual tanks installed therein and the head with each other;

wherein the controller is configured to obtain volume information regarding the volume of one of the plurality of individual tanks installed in each of the tank installing sections; and in the second purge processing, the controller controls the purge mechanism to make a pressure applying time during which the conveying pressure is applied to the pigment ink to be long, based on the volume information obtained by the volume information obtaining section, in a case that the volume of one of the plurality of individual tanks installed in each of the tank installing sections is great.

12. The ink-jet printer according to claim 1, wherein in a case that the controller judges that the sedimentation amount is less than the predetermined amount, the controller executes the first purge processing.

13. The ink-jet printer according to claim 1, wherein the pigment ink includes a first pigment ink and a second pigment ink containing a pigment which is less likely to sediment than a pigment contained in the first pigment ink;

the tank includes a first tank configured to store the first pigment ink and a second tank configured to store the second pigment ink;

the head has a head body having first nozzles and second nozzles as the nozzles, and a channel structure connected to the head body;

the channel structure has:

a first liquid channel communicating with the first nozzles such that the first pigment ink stored in the first tank is supplied to the first nozzles, a second liquid channel communicating with the second nozzles such that the second pigment ink stored in the second tank is supplied to the second nozzles, a first exhaust channel communicating with the first liquid channel and having an opening at a forward end thereof, and a second exhaust channel communicating with the second liquid channel and having an opening at a forward end thereof;

the purge mechanism is provided with:

an exhaust cap configured to make contact with the channel structure and to collectively cover the opening of the first exhaust channel and the opening of the second exhaust channel, and a suction pump connected to the exhaust cap; and the controller executes, before executing the initial introduction purge processing, an exhausting processing for performing suction by the suction pump so as to exhaust air inside the first liquid channel via the first exhaust channel, and so as to exhaust air inside the second liquid channel via the second exhaust channel.

14. The ink-jet printer according to claim 1, wherein the head is connected to a liquid discharge port disposed in a lower portion of the tank.

15. An ink-jet printer comprising:

a tank configured to store a pigment ink;

a head which is connected to the tank, which has nozzles for jetting the pigment ink supplied from the tank; and a purge mechanism; and a controller configured to control the head and the purge mechanism to thereby perform:

obtaining sedimentation information regarding a sedimentation amount of a pigment contained in the pigment ink in the tank;

judging whether or not the sedimentation amount of the pigment in the tank is not less than a predetermined amount, based on the obtained sedimentation information;

executing a first purge operation as an introduction purge processing for introducing the pigment ink from the tank to the head; and executing, as the introduction purge processing, a second purge processing capable of discharging, from the nozzles, the pigment ink in a larger amount than that in the first purge processing, in a case that the controller judges that the sedimentation amount is not less than the predetermined amount.

* * * * *